US009599914B2

(12) United States Patent
Uematsu et al.

(10) Patent No.: US 9,599,914 B2
(45) Date of Patent: Mar. 21, 2017

(54) ELECTROPHOTOGRAPHIC MEMBER HAVING BOW-SHAPED RESIN PARTICLES DEFINING CONCAVITY AND PROTRUSION AT SURFACE THEREOF

(71) Applicant: CANON KABUSHIKI KAISHA, Tokyo (JP)

(72) Inventors: Atsushi Uematsu, Fuji (JP); Tomohito Taniguchi, Suntou-gun (JP); Masahiro Watanabe, Mishima (JP); Noboru Miyagawa, Suntou-gun (JP); Taichi Sato, Numazu (JP); Takehiko Aoyama, Suntou-gun (JP); Takeshi Yoshidome, Kitakyushu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/077,167

(22) Filed: Mar. 22, 2016

(65) Prior Publication Data

US 2016/0291487 A1 Oct. 6, 2016

(30) Foreign Application Priority Data

Apr. 3, 2015 (JP) ..... 2015-077015

(51) Int. Cl.

| | |
|---|---|
| ***G03G 15/00*** | (2006.01) |
| ***G03G 5/043*** | (2006.01) |
| ***G03G 5/05*** | (2006.01) |

(52) U.S. Cl.

CPC ..... *G03G 5/043* (2013.01); *G03G 5/0525* (2013.01)

(58) Field of Classification Search

CPC ..... G03G 5/043; G03G 5/0525
USPC ..... 399/176
See application file for complete search history.

(56) References Cited

U.S. PATENT DOCUMENTS

| | | | |
|---|---|---|---|
| 7,727,134 | B2 | 6/2010 | Nakamura et al. |
| 8,383,234 | B2 | 2/2013 | Mayuzumi et al. |
| 8,532,534 | B2 | 9/2013 | Taniguchi et al. |
| 8,538,298 | B2 | 9/2013 | Harada et al. |
| 8,548,359 | B2 | 10/2013 | Taniguchi et al. |

(Continued)

FOREIGN PATENT DOCUMENTS

| | | |
|---|---|---|
| EP | 0 636 949 | 2/1995 |
| EP | 1 355 201 | 10/2003 |

(Continued)

*Primary Examiner* — Quana M Grainger
(74) *Attorney, Agent, or Firm* — Fitzpatrick, Cella, Harper & Scinto

(57) ABSTRACT

The electrophotographic member includes an electro-conductive substrate and an electro-conductive resin layer as the surface layer on the substrate. The electro-conductive resin layer contains a binder and a bowl-shaped resin particle; the surface of electrophotographic member has a concavity derived from the opening of the bowl-shaped resin particle, a protrusion derived from the edge portion of the opening and the electro-conductive resin layer; and when the surface of the member is observed using a scanning electron microscope at an accelerating voltage (1 kV) and a magnification (×2000) while applying a DC voltage (50 to 100 V) between an electrode disposed opposite to the electrophotographic member and the substrate, the brightness of the protrusion, K1, the brightness of the bottom of the concavity, K2, and the brightness of the exposed surface of the electro-conductive resin layer, K3, satisfy K2<K1, K3<K1 and 0.8≤K2/K3≤1.2.

6 Claims, 6 Drawing Sheets

(56) References Cited

U.S. PATENT DOCUMENTS

| | | | |
|---|---|---|---|
| 8,550,969 | B2 | 10/2013 | Taniguchi et al. |
| 8,628,854 | B2 | 1/2014 | Yamauchi et al. |
| 8,745,870 | B2 | 6/2014 | Kawamura et al. |
| 8,771,818 | B2 | 7/2014 | Nishioka et al. |
| 8,852,743 | B2 | 10/2014 | Kikuchi et al. |
| 8,971,766 | B2 | 3/2015 | Taniguchi et al. |
| 9,075,333 | B2 | 7/2015 | Uematsu et al. |
| 9,098,006 | B2 | 8/2015 | Uematsu et al. |
| 9,146,482 | B2 | 9/2015 | Watanabe et al. |
| 9,158,213 | B2 | 10/2015 | Taniguchi et al. |
| 9,256,153 | B2 | 2/2016 | Aoyama et al. |
| 9,268,243 | B2 | 2/2016 | Aoyama et al. |
| 9,274,442 | B2 | 3/2016 | Sato et al. |
| 9,274,496 | B2 | 3/2016 | Miyagawa et al. |
| 2010/0267537 | A1 | 10/2010 | Kashihara et al. |
| 2011/0305481 | A1 | 12/2011 | Taniguchi et al. |
| 2012/0076539 | A1 | 3/2012 | Sato et al. |
| 2013/0223886 | A1 | 8/2013 | Miyagawa et al. |
| 2013/0236214 | A1 | 9/2013 | Koide et al. |
| 2013/0251403 | A1 | 9/2013 | Matsuda et al. |
| 2013/0281276 | A1 | 10/2013 | Watanabe et al. |
| 2014/0221183 | A1 | 8/2014 | Miyagawa et al. |
| 2014/0255838 | A1 | 9/2014 | Matsuda et al. |
| 2014/0274628 | A1 | 9/2014 | Matsuda et al. |
| 2014/0287899 | A1 | 9/2014 | Nishioka et al. |
| 2014/0301754 | A1 | 10/2014 | Uematsu et al. |
| 2014/0334843 | A1 | 11/2014 | Taniguchi et al. |
| 2015/0087489 | A1 | 3/2015 | Sato et al. |
| 2015/0198905 | A1 | 7/2015 | Kikuchi et al. |

FOREIGN PATENT DOCUMENTS

| | | | |
|---|---|---|---|
| JP | 2005-128144 | | 5/2005 |
| JP | 2008-276026 | A | 11/2008 |
| JP | 4799706 | A | 10/2011 |
| JP | 2011-237470 | | 11/2011 |
| JP | 2012-103414 | | 5/2012 |
| JP | 2012-130414 | A | 5/2012 |

ELECTROPHOTOGRAPHIC MEMBER HAVING BOW-SHAPED RESIN PARTICLES DEFINING CONCAVITY AND PROTRUSION AT SURFACE THEREOF

BACKGROUND OF THE INVENTION

Field of the Invention

The present invention relates to an electrophotographic member which can be used as a charging member or the like to charge the surface of an electrophotographic photosensitive member as a member to be charged to a predetermined electrical potential by applying a voltage, and a process cartridge and an electrophotographic image-forming apparatus (hereinafter, referred to as an "electrophotographic apparatus") using the same.

Description of the Related Art

An electrophotographic apparatus employing an electrophotographic method primarily includes an electrophotographic photosensitive member (hereinafter, simply referred to as "photosensitive member"), a charging device, an exposing device, a developing device, a transferring device and a fixing device. As the charging device, a contact charging device which charges the surface of a photosensitive member by applying a DC voltage or a voltage of a DC voltage superimposed with an AC voltage to the charging member brought into contact with or closely disposed on the surface of the photosensitive member is commonly employed.

Japanese Patent Application Laid-Open No. 2012-103414 and Japanese Patent No. 4799706 disclose a charging member including an electro-conductive resin layer containing a bowl-shaped resin particle having an opening, wherein the charging member has an uneven shape derived from the opening and edge portion of the bowl-shaped resin particle on the surface. In the charging member described in Japanese Patent Application Laid-Open No. 2012-103414 and Japanese Patent No. 4799706, the edge portion of the opening of the bowl-shaped resin particle on the surface is elastically deformed to relax the contact pressure onto a photosensitive member. As a result, the nonuniform abrasion of a photosensitive member can be suppressed even in a long-term use.

The present inventors have confirmed that the charging member according to Japanese Patent Application Laid-Open No. 2012-103414 and Japanese Patent No. 4799706 can exhibit a stable charging performance and effectively suppress the nonuniform abrasion of a photosensitive member in contact with the charging member. However, the present inventors have recognized that the charging member according to Japanese Patent Application Laid-Open No. 2012-103414 and Japanese Patent No. 4799706 still needs to be improved in the stability of charging performance in response to the recent increase in the speed of electrophotographic image-forming process.

SUMMARY OF THE INVENTION

The present invention is directed to providing a charging member which suppresses the nonuniform abrasion of a photosensitive member and suppresses the occurrence of a spotted image and horizontally streaked image due to abnormal discharge even in an electrophotographic apparatus with an increased speed.

Further, the present invention is directed to providing a process cartridge and an electrophotographic apparatus which contribute to forming a high-quality electrophotographic image.

According to one aspect of the present invention, there is provided an electrophotographic member comprising an electro-conductive substrate and an electro-conductive resin layer as the surface layer on the substrate. The electro-conductive resin layer contains a binder and retains a bowl-shaped resin particle having an opening, so that the opening is exposed at the surface of the electrophotographic member. The surface of the electrophotographic member has a concavity derived from the opening of the bowl-shaped resin particle exposed at the surface, and a protrusion derived from the edge of the opening of the bowl-shaped resin particle exposed at the surface. A part of the surface of the electrophotographic member is constituted by the electro-conductive resin layer. When the surface of the electrophotographic member is observed with a scanning electron microscope at an accelerating voltage of 1 kV and a magnification of ×2000 while applying a DC voltage of 50 V or more and 100 V or less between an electrode disposed opposite to the electrophotographic member and the substrate, and a brightness observed at the protrusion is defined as K1, a brightness observed at the bottom of the concavity is defined as K2, and a brightness observed at the exposed surface of the electro-conductive resin layer is defined as K3, K1, K2 and K3 satisfy the following expressions (1) to (3):

$$K2<K1 \quad \text{Expression (1)}$$

$$K3<K1 \quad \text{Expression (2)}$$

$$0.8\leq K2/K3\leq 1.2. \quad \text{Expression (3)}$$

Further, according to another aspect of the present invention, there is provided an electrophotographic member comprising an electro-conductive substrate and an electro-conductive resin layer as the surface layer on the substrate. The electro-conductive resin layer contains a crosslinked rubber as a binder, and retains a bowl-shaped resin particle having an opening so that the opening is exposed at the surface of the electrophotographic member. The surface of the electrophotographic member has a concavity derived from the opening of the bowl-shaped resin particle exposed at the surface, and a protrusion derived from the edge of the opening of the bowl-shaped resin particle exposed at the surface. A part of the surface of the electrophotographic member is constituted by the electro-conductive resin layer. The electro-conductive resin layer is formed by thermally crosslinking a layer of an electro-conductive, thermally crosslinkable rubber composition containing an electro-conductive fine particle in the presence of oxygen.

Furthermore, according to another aspect of the present invention, there is provided an electrophotographic member comprising an electro-conductive substrate and an electro-conductive resin layer as the surface layer on the substrate. The electro-conductive resin layer contains a binder, and retains a bowl-shaped resin particle having an opening so that the opening is exposed at the surface of the electrophotographic member. The surface of the electrophotographic member has a concavity derived from the opening of the bowl-shaped resin particle exposed at the surface and a protrusion derived from the edge of the opening of the bowl-shaped resin particle exposed at the surface. A part of the surface of the electrophotographic member is constituted by the electro-conductive resin layer. Further, an electro-conductive fine particle is present at a surface of the concavity.

Moreover, according to another aspect of the present invention, there is provided a method for producing an electrophotographic member comprising an electro-conductive substrate and an electro-conductive resin layer as the surface layer on the substrate, the method including: forming a coating layer of a composition containing a hollow-shaped resin particle dispersed in a binder on the substrate; grinding a surface of the coating layer, and partly removing a shell of the hollow-shaped resin particle to form a bowl-shaped resin particle having an opening, and to make a concavity derived from the opening of the bowl-shaped resin particle and a protrusion derived from an edge of the opening on the surface of the coating layer; and allowing an electro-conductive fine particle to be present at a surface of the concavity.

In addition, according to another aspect of the present invention, there is provided a method for producing an electrophotographic member comprising an electro-conductive substrate and an electro-conductive resin layer as the surface layer on the substrate including: forming a coating layer of a thermally crosslinkable rubber composition containing an electro-conductive fine particle, a thermally crosslinkable rubber and a hollow-shaped resin particle on the substrate; grinding a surface of the coating layer, and partly removing a shell of the hollow-shaped resin particle to form a bowl-shaped resin particle having an opening, and to make a layer retaining the bowl-shaped resin particle so that the opening is exposed at the surface thereof; and thermally crosslinking the thermally crosslinkable rubber in the coating layer in the presence of oxygen to obtain an electrophotographic member having a concavity derived from the opening and a protrusion derived from an edge of the opening on the surface thereof, wherein a part of the surface is constituted by the electro-conductive resin layer.

Additionally, according to another aspect of the present invention, there is provided a process cartridge comprising the above electrophotographic member and an electrophotographic photosensitive member and being configured to be attachable to and detachable from the main body of an electrophotographic apparatus. Still additionally, according to another aspect of the present invention, there is provided an electrophotographic apparatus comprising the above electrophotographic member and an electrophotographic photosensitive member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 2A:
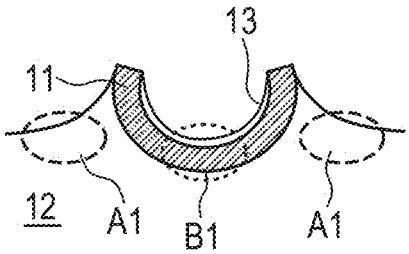
FIGS. 2A and 2B are diagrams illustrating the configuration in the vicinity of the surface of a conventional charging member.

According to an investigation by the present inventors, the charging member according to Japanese Patent Application Laid-Open No. 2012-103414 is not necessarily sufficient in charging stability for an electrophotographic image-forming apparatus with an increased speed. FIG. 2A illustrates the charging member according to Japanese Patent Application Laid-Open No. 2012-103414. For the bowl-shaped resin particle, a known resin is used. In the case that a voltage is applied between a photosensitive member and the charging member, discharge from the concavity (B1) derived from the bowl-shaped resin particle is less likely to occur because the bowl-shaped resin particle has insulation properties, and discharge tends to occur only from the electro-conductive resin layer (A1) exposed at the surface. In the case of an electrophotographic apparatus with an increased speed, charging time for a photosensitive member is short and therefore it is needed to set the electrical potential on the surface of a photosensitive member to a desired electrical potential in a short time. Accordingly, in the case of the charging member according to Japanese Patent Application Laid-Open No. 2012-103414, it is needed to set the electrical potential on the surface of a photosensitive member to a desired electrical potential by a large discharge only from the electro-conductive resin layer (A1) exposed at the surface. Then, an electric field is concentrated on the electro-conductive resin layer (A1) exposed at the surface and abnormal discharge tends to occur due to this concentrated electric field. Particularly, under a low temperature and low humidity environment, in which discharge phenomenon is unstable, the above phenomenon is likely to occur and may become apparent as a spotted image.

Figure 2B:
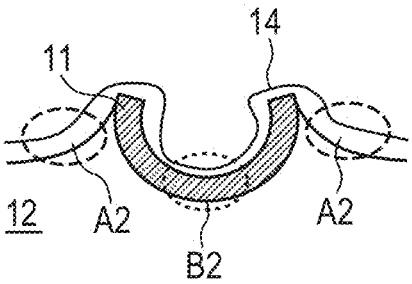

Further, FIG. 2B illustrates the charging member according to Japanese Patent No. 4799706. In the charging member according to Japanese Patent No. 4799706, the bowl-shaped resin particle 11 is covered with the electro-conductive resin layer 14. Therefore, discharge can occur not only from the electro-conductive resin layer (A2) exposed at the surface, but also from the concavity (B2) derived from the bowl-shaped resin particle. As a result, the occurrence of a spotted image due to a concentrated electric field, which occurs in the charging member according to Japanese Patent Application Laid-Open No. 2012-103414, can be suppressed. However, the charging member according to Japanese Patent No. 4799706 tends to cause a phenomenon that, when being driven-rotated, a state in which the rotational speed differs between the charging member and a photosensitive member (hereinafter, referred to as "stick-slip") is irregularly generated. The mechanism of the generation of this phenomenon will be described in detail later. Particularly, in the case that an electrophotographic apparatus with an increased speed is used, the above driven-rotation properties are significantly lowered and abnormal discharge due to this lowering may cause a horizontally streaked image in some cases. That is, in association with the increase in the speed of an electrophotographic apparatus, a spotted image and a horizontally streaked image, which were not generated previously, may appear, and the present inventors have recognized that suppressing abnormal discharge due to a concentrated electric field and stick-slip is a problem to be solved in order to form an image more stably.

Accordingly, the present inventors made a diligent investigation.

As a result, the present inventors have invented a charging member which suppresses the abrasion of a photosensitive member and can exhibit a more stable charging performance even being applied for an electrophotographic image-forming process with an increased speed.

Figure 3A:
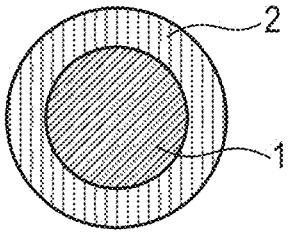
FIGS. 3A and 3B are schematic cross-sectional views illustrating one example of the charging member according to the present invention.
Figure 3B:
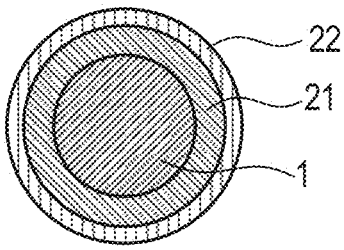

FIGS. 3A and 3B illustrate a circumferential cross-section of the roller-shaped electrophotographic member (hereinafter, also referred to as "charging roller") according to one embodiment of the present invention.

Figure 1A:
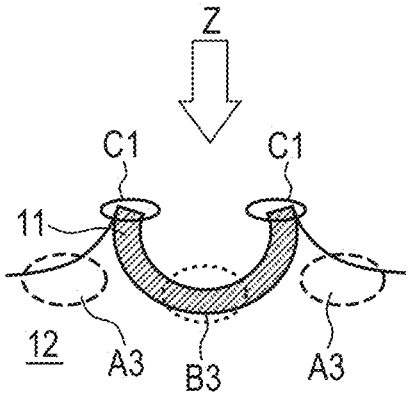
FIGS. 1A and 1B are diagrams illustrating the configuration in the vicinity of the surface of the electrophotographic member (charging member) according to the present invention and the contact state with a photosensitive member.
Figure 1B:
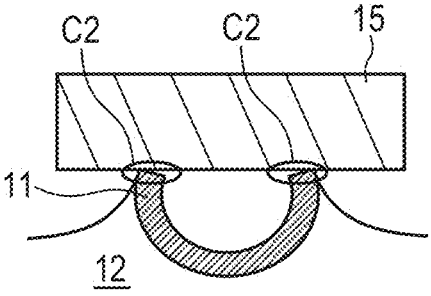

As illustrated in FIG. 3A, the charging roller includes an electro-conductive and an electro-conductive resin layer 2. Alternatively, as illustrated in FIG. 3B, the charging roller includes a substrate 1, an electro-conductive resin layer 21 as an intermediate layer on the substrate and an electro-conductive resin layer 22 as the surface layer on the intermediate layer. The electro-conductive resin layer as the surface layer contains a binder. Further, as illustrated in FIG. 1A, the electro-conductive resin layer as the surface layer retains a bowl-shaped resin particle having an opening so that the opening is exposed at the surface of the electrophotographic member. Furthermore, the surface of the electrophotographic member has a binder, a concavity derived from the opening of the bowl-shaped resin particle exposed at the surface (hereinafter, sometimes simply referred to as "concavity of the bowl") and a protrusion derived from the edge of the opening of the bowl-shaped resin particle (hereinafter, sometimes simply referred to as "edge of the bowl") exposed at the surface (hereinafter, sometimes simply referred to as "protrusion of the bowl"). In FIGS. 1A and 1B, which illustrates the vicinity of the surface of the electrophotographic member, a binder (A3) and the concavity of a bowl (B3) and the protrusion of a bowl (C1) are present on the surface of the electrophotographic member.

When the surface of the electrophotographic member according to the present invention is observed using a scanning electron microscope at an accelerating voltage of 1 kV and a magnification of ×2000 while applying a DC voltage of 50 V or more and 100 V or less between an electrode disposed opposite to the electrophotographic member and the electro-conductive substrate, the brightness of the protrusion of the bowl, K1, the brightness of the bottom of the concavity of the bowl, K2, and the brightness of the exposed surface of the electro-conductive resin layer, K3, satisfy the following expressions (1) to (3):

$$K2<K1 \quad \text{Expression (1)}$$

$$K3<K1 \quad \text{Expression (2)}$$

$$0.8\leq K2/K3\leq 1.2. \quad \text{Expression (3)}$$

The electrophotographic member is used for an electrophotographic member such as a charging member, a developing member and a transfer member. In the following, a charging member is described as a specific example of the electrophotographic member according to one aspect of the present invention.

In the charging member, the brightnesses K1 to K3 are calculated by observing from the upper side of the surface of the charging member (the direction Z in FIG. 1A). The brightness K2 is brightness due to the electroconductivity of a portion including the bowl-shaped resin particle and the binder immediately beneath the bowl-shaped resin particle. Measurement for the brightness K2 enables to evaluate the discharging state from the bottom of the concavity of the bowl accurately. The above brightness K2 can be calculated by appropriately setting the accelerating voltage of the above electron microscope.

As will be described in detail later, brightness correlates with the electroconductivity of an observed site. That is, the lower the brightness, the higher the electroconductivity, and the higher the brightness, the lower the electroconductivity.

Expressions (1) and (2) indicate that the electroconductivity $EC_1$ of the protrusion of the bowl is lower than the electroconductivity $EC_3$ of the binder exposed at the surface and lower than the electroconductivity $EC_2$ of the bottom of the concavity of the bowl. When the charging member is brought into contact with a photosensitive member, due to the fact that the electroconductivity $EC_1$ of the protrusion of the bowl being in contact with the surface of the photosensitive member is low, an electrical attraction can be maintained between the surface of the photosensitive member and the protrusion of the bowl.

In the following, the electrical attraction which acts between the surface of a photosensitive member and the protrusion of the bowl will be described.

In the charging member having an uneven shape derived from the opening of the bowl-shaped resin particle exposed at the surface of the charging member, when being brought into contact with a photosensitive member, the protrusion (C1) comes into contact with the photosensitive member 15 while the protrusion being elastically deformed, as illustrated in FIG. 1B. In forming an electrophotographic image, the charging member is applied with a voltage to charge the photosensitive member by discharge at a microgap between the charging member and the photosensitive member. This discharge is caused by the ionization of an air in the microgap, which is so-called Townsend discharge. Then, positively charged and negatively charged particles generated by the ionization of a molecule in the air are guided to the surface of the photosensitive member or the charging member by the electric field formed in the microgap. Due to the charged particle guided to the photosensitive member, the surface of the photosensitive member is charged. In addition, the charged particle with the opposite polarity to the polarity of the charged particle guided to the photosensitive member is guided to the charging member, and the charging member is also charged. In the case that the electroconductivity $EC_1$ of the protrusion of the bowl is low, the surface of the charging member is charged-up with the electric charge induced by Townsend discharge. This charge-upping electric charge causes an electrical attraction between the photosensitive member 15 and the protrusion of the bowl and as a result the charging member and the photosensitive member attract each other more strongly.

In the charging member, an electrical attraction which acts between the photosensitive member and the protrusion of the bowl improves the driven-rotation properties of the charging member against the photosensitive member, and stick-slip is suppressed even in a high-speed machine.

In addition to the above, the charging member satisfies expression (3). K2/K3 in expression (3) is the ratio of the brightness due to the electroconductivity $EC_2$ of the bottom (B3) of the concavity of the bowl to the brightness due to the electroconductivity $EC_3$ of the binder (A3) exposed at the surface, as in FIG. 1A. As this value is closer to 1, the electroconductivity $EC_2$ of the bottom of the concavity of the bowl becomes closer to the electroconductivity $EC_3$ of the binder exposed at the surface, which enables to relax the concentration of an electric field on the binder (A3) exposed at the surface to suppress the above-described abnormal discharge.

A method for setting the value of K2/K3 within the range represented by expression (3) will be described later.

<Charging Member>

A schematic cross-sectional view of one example of the charging member is illustrated in FIGS. 3A and 3B. The charging member in FIG. 3A includes an electro-conductive substrate 1 and an electro-conductive resin layer 2. The electro-conductive resin layer may have a two-layer configuration having electro-conductive resin layers 21 and 22, as illustrated in FIG. 3B. Here, the electro-conductive resin layer contains a binder and a bowl-shaped resin particle.

The electro-conductive substrate 1 and electro-conductive resin layer 2 or layers which are sequentially layered on the electro-conductive substrate 1 (e.g., the electro-conductive resin layers 21 and 22 illustrated in FIG. 3B) may be bonded together via an adhesive. In this case, the adhesive can be electro-conductive. A know electro-conductive adhesive can be used. Examples of the adhesive base include thermosetting resins and thermoplastic resins, and a known resin can be used such as a urethane, acrylic, polyester, polyether and epoxy resin. For an electro-conductive agent to impart electro-conductive properties to an adhesive, one of appropriately selected electro-conductive fine particles described in detail later can be used singly, or two or more thereof can be used in combination.

[Electro-Conductive Substrate]

An electro-conductive substrate used for the charging member has electro-conductive properties and has a function to support an electro-conductive resin layer to be provided thereon. Examples of the material of an electro-conductive substrate include metals such as iron, copper, aluminum and nickel, and alloys thereof (such as a stainless steel).

[Electro-Conductive Resin Layer]

Figure 5A:
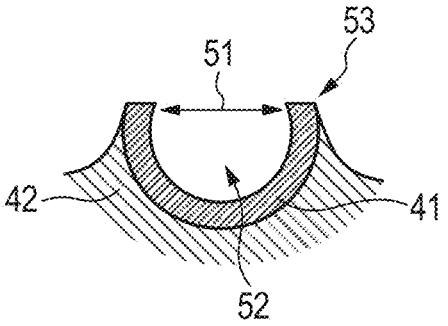
FIGS. 5A and 5B are partial cross-sectional views in the vicinity of the surface of the charging member according to the present invention.
Figure 5B:
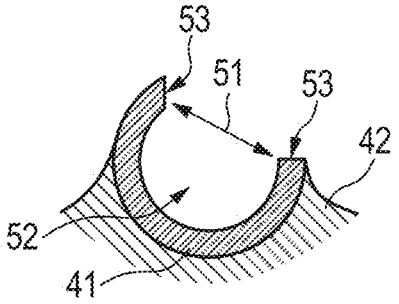

FIGS. 5A and 5B are partial cross-sectional views in the vicinity of the surface of an electro-conductive resin layer included in the surface layer of the charging member according to the present invention. The bowl-shaped resin particle 41, one of bowl-shaped resin particles contained in the electro-conductive resin layer, is exposed at the surface of the charging member. And the surface of the charging member has the concavity 52 derived from the opening 51 of the bowl-shaped resin particle exposed at the surface and the protrusion derived from the edge 53 of the opening of the bowl-shaped resin particle exposed at the surface. The edge 53 can have a form illustrated in FIGS. 5A and 5B, for example.

Figure 6:
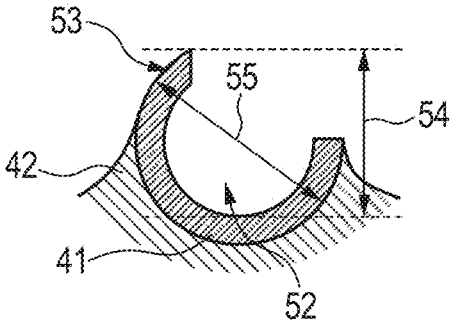
FIG. 6 is a partial cross-sectional view in the vicinity of the surface of the charging member according to the present invention.

The height difference 54 between the top of the protrusion derived from the edge 53 of the opening of the bowl-shaped resin particle and the bottom of the concavity defined by the shell of the said bowl-shaped resin particle illustrated in FIG. 6 is preferably 5 μm or more and 100 μm or less, and particularly preferably 10 μm or more and 80 μm or less. The height difference within this range enables to maintain the point contact of the edge of the bowl in the nip portion more reliably. The ratio of the maximum diameter 55 of the bowl-shaped resin particle to the height difference 54 between the top of the protrusion and the bottom of the concavity, i.e., [maximum diameter]/[height difference] of the resin particle is preferably 0.8 or more and 3.0 or less, and particularly preferably 1.1 or more and 1.6 or less. The value of [maximum diameter]/[height difference] of the resin particle within this range enables to maintain the point contact of the edge of the bowl in the nip portion more reliably. In the present invention, the "maximum diameter" of a bowl-shaped resin particle is defined as the maximum length in a circular projection image provided by the bowl-shaped resin particle. In the case that the bowl-shaped resin particle provides a plurality of circular projection images, the maximum value among the maximum lengths in the respective projection images is defined as the "maximum diameter" of the bowl-shaped resin particle.

The surface state of the electro-conductive resin layer can be controlled as in the following by forming the uneven shape. The ten-point average surface roughness (Rzjis) is preferably 5 μm or more and 65 μm or less, and particularly preferably 10 μm or more and 50 μm or less. The mean peak spacing (Sm) of the surface is preferably 30 μm or more and 200 μm or less, and particularly preferably 40 μm or more and 150 μm or less. The Rzjis and Sm within the above respective ranges enable to maintain the point contact of the edge of the bowl in the nip portion more reliably. Methods for measuring the ten-point average roughness (Rzjis) of the surface and the mean peak spacing (Sm) of the surface will be described in detail later.

Figure 7A:
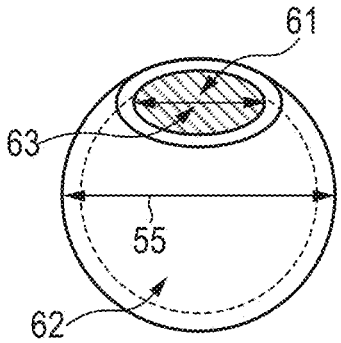
FIGS. 7A, 7B, 7C, 7D and 7E are diagrams illustrating the shape of the bowl-shaped resin particle used in the present invention.
Figure 7B:
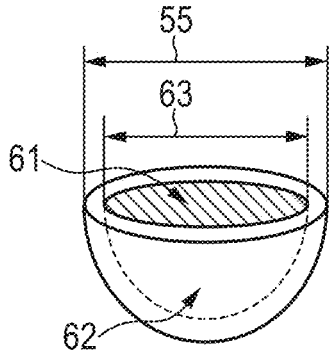
Figure 7C:
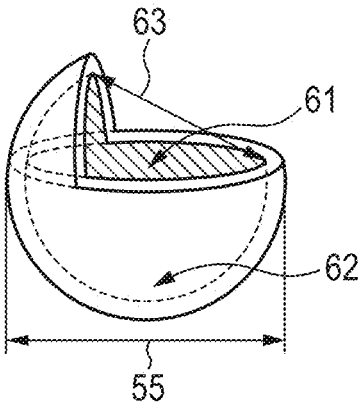
Figure 7D:
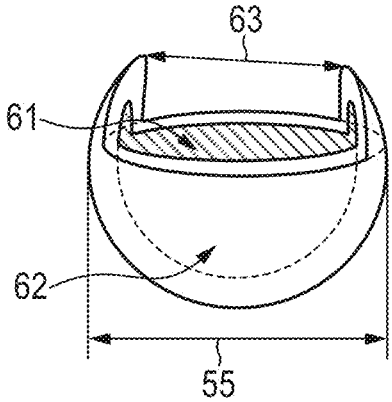
Figure 7E:
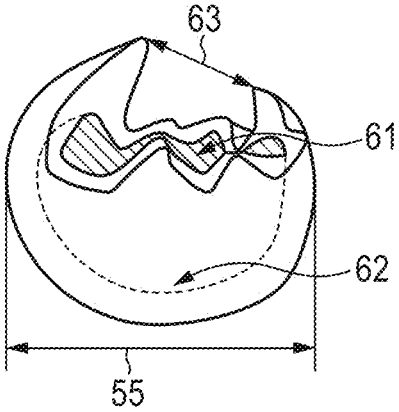

Examples of the bowl-shaped resin particle are illustrated in FIGS. 7A to 7E. In the present invention, "bowl-shaped" refers to a shape having the opening portion 61 and the round concavity 62 of the opening portion. In the "opening portion", the edge of the bowl may be flat as illustrated in FIGS. 7A and 7B, or the edge of the bowl may have unevenness as illustrated in FIGS. 7C to 7E.

The rough standard value for the maximum diameter 55 of the bowl-shaped resin particle is 10 μm or more and 150 μm or less, and particularly 20 μm or more and 100 μm or less. In addition, the ratio of the maximum diameter 55 of the bowl-shaped resin particle to the minimum diameter 63 of the opening portion, i.e., [maximum diameter]/[minimum diameter of opening portion] of the bowl-shaped resin particle is more preferably 1.1 or more and 4.0 or less.

The thickness of the shell (the difference between the outer diameter and inner diameter of the periphery) around the opening portion of the bowl-shaped resin particle is preferably 0.1 μm or more and 3 μm or less, and particularly preferably 0.2 μm or more and 2 μm or less. With regard to the above thickness of the shell, the "maximum thickness" is preferably three times the "minimum thickness" or less, and more preferably twice the "minimum thickness" or less.

[Binder]

A known rubber or resin can be used for the binder contained in the electro-conductive resin layer. Examples of the rubber include natural rubbers and vulcanized products thereof, and synthetic rubbers. Examples of the synthetic rubber are as follows, for example: an ethylene-propylene rubber, a styrene-butadiene rubber (SBR), a silicone rubber, a urethane rubber, an isopropylene rubber (IR), a butyl rubber, an acrylonitrile-butadiene rubber (NBR), a chloroprene rubber (CR), a butadiene rubber (BR), an acrylic rubber, an epichlorohydrin rubber and a fluorine rubber.

Examples of the resin which can be used include thermosetting resins and thermoplastic resins. Among them, a fluorine resin, a polyamide resin, an acrylic resin, a polyurethane resin, an acrylic urethane resin, a silicone resin and a butyral resin are more preferred. One of them may be used singly, or two or more thereof may be used in combination. Alternatively, monomers of some of these raw materials for a binder may be copolymerized into a copolymer. For a reason described later, it is more preferred to use a styrene-butadiene rubber (SBR), a butyl rubber, an acrylonitrile-butadiene rubber (NBR), a chloroprene rubber (CR) or a butadiene rubber (BR), each of which has a double bond in the molecule and has a high heat resistance.

A silicone oil can be added to the electro-conductive resin layer, the detail of which will be described later. The structure of the silicone oil to be added can be linear dimethylpolysiloxane. In the case that the parts of the silicone oil to be added is 0.2 parts by mass or less based on 100 parts by mass of the binder, an effect to control the electroconductivity of the charging member, which will be described later, is small, and in the case of 2.0 parts by mass or more, the silicone oil is poorly incorporated into the binder to lower the processability. Therefore, the parts of the silicone oil to be added is preferably 0.2 parts by mass or more and 2.0 parts by mass or less, and more preferably 0.4 parts by mass or more and 1.0 parts by mass or less. The viscosity of the silicone oil, which will be described later, is preferably 20 $mm^2/s$ or more and 200 $mm^2/s$ or less, and more preferably 30 $mm^2/s$ or more and 100 $mm^2/s$ or less.

[Electro-Conductive Fine Particle]

The rough standard value for the volume resistivity of the electro-conductive resin layer can be $1\times10^2$ Ωcm or more and $1\times10^{16}$ Ωcm or less under an environment with a temperature of 23° C. and a relative humidity of 50%. The volume resistivity within this range facilitates to suitably charge the photosensitive member by discharge. For this purpose, a known electro-conductive fine particle may be contained in the electro-conductive resin layer. Examples of the electro-conductive fine particle include particles of a metal oxide, a metal, carbon black and graphite. Further, one of these electro-conductive fine particles can be used singly, or two or more thereof can be used in combination. The rough standard value for the content of the electro-conductive fine particle in the electro-conductive resin layer is 2 to 200 parts by mass, and particularly 5 to 100 parts by mass based on 100 parts by mass of the binder.

[Method for Forming Electro-Conductive Resin Layer]

A method for forming the electro-conductive resin layer will be illustrated in the following. First, a coating layer of a composition in which a hollow-shaped resin particle is dispersed in a binder is formed on an electro-conductive substrate. Thereafter, the shell of the hollow-shaped resin particle is partly removed into a bowl shape having an opening by grinding the surface of the coating layer so as to form a concavity derived from the opening of the bowl-shaped resin particle and a protrusion derived from the edge of the opening of the bowl-shaped resin particle (hereinafter, a shape having these concave and protrusion is referred to as "uneven shape derived from the opening of the bowl-shaped resin particle"). Subsequently, the electroconductivity of the material present on the surface of the coating layer is adjusted by application of an electro-conductive fine particle onto a surface of the concavity, heat treatment for the coating layer in an oxygen-containing atmosphere or the like.

In the following, each step in the method for forming an electro-conductive resin layer will be described in detail. Among the coating layers, the coating layer before grinding is referred to as the "pre-coating layer". The "shell of the hollow-shaped resin particle" as a raw material for an electrophotographic member is referred to as the "bowl of the bowl-shaped resin particle" in the electrophotographic member in which a bowl-shaped resin particle having an opening is formed by grinding.

[Dispersion of Resin Particle in Pre-Coating Layer]

First, methods for dispersing a hollow-shaped resin particle in the pre-coating layer will be described. One example of the method is a method in which a coating film of an electro-conductive resin composition in which a hollow-shaped resin particle containing a gas inside is dispersed in a binder is formed on a substrate, and the coating film is dried, cured or crosslinked, for example. Here, an electro-conductive particle can be contained in the electro-conductive resin composition. The material used for the hollow-shaped resin particle is preferably a resin having a polar group, and more preferably a resin having the unit represented by the following formula (4) from the viewpoint of having a low gas permeability and a high impact resilience. Particularly from the viewpoint of facilitating to control grinding properties, a resin having both of the unit represented by formula (4) and the unit represented by formula (8) is more preferred.

Formula (4)

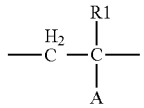

In formula (4), A is at least one selected from the group consisting of the following formulas (5), (6) and (7); and R1 is a hydrogen atom or an alkyl group having 1 to 4 carbon atoms.

Formula (5)

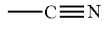

Formula (6)

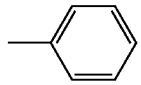

Formula (7)

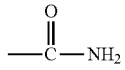

-continued

Formula (8)

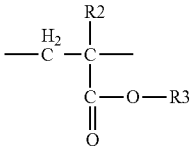

In formula (8), R2 is a hydrogen atom or an alkyl group having 1 to 4 carbon atoms; and R3 is a hydrogen atom or an alkyl group having 1 to 10 carbon atoms.

Another example of the method is a method in which a thermally expandable microcapsule, a particle containing an included substance inside which expands to make the particle a hollow-shaped resin particle when being heated, is used. In this method, an electro-conductive resin composition in which a thermally expandable microcapsule is dispersed in a binder is produced, with which an electro-conductive substrate is coated and dried, cured or crosslinked, for example. In the case of this method, a hollow-shaped resin particle can be formed by using heat during drying, curing or crosslinking a binder used for the pre-coating layer to expand the included substance. At this time, the particle diameter can be controlled by controlling the temperature conditions.

In the case that a thermally expandable microcapsule is used, it is needed to use a thermoplastic resin as the binder. Examples of the thermoplastic resin are as follows, for example: an acrylonitrile resin, a vinyl chloride resin, a vinylidene chloride resin, a methacrylic acid resin, a styrene resin, a butadiene resin, a urethane resin, an amide resin, a methacrylonitrile resin, an acrylic acid resin, acrylate resins and methacrylate resins. Among them, particularly a thermoplastic resin containing at least one selected from the group consisting of an acrylonitrile resin, a vinylidene chloride resin and a methacrylonitrile resin, each of which has a low gas transmission rate and a high impact resilience, is more preferably used in order to control to the electro-conductivity distribution described later. One of these thermoplastic resins can be used singly, or two or more thereof can be used in combination. Further, monomers of some of these thermoplastic resins may be copolymerized into a copolymer.

As the substance to be included in a thermally expandable microcapsule, a substance which gasifies to expand at a temperature lower than or equal to the softening point of the thermoplastic resin can be used, and examples thereof are as follows, for example: low boiling point liquids such as propane, propylene, butene, n-butane, isobutane, n-pentane and isopentane; and high boiling point liquids such as n-hexane, isohexane, n-heptane, n-octane, isooctane, n-decane and isodecane.

The above thermally expandable microcapsule can be produced by using a known production method such as a suspension polymerization method, an interfacial polymerization method, an interfacial settling method and an in-liquid drying method. Examples of the suspension polymerization method include a method in which a polymerizable monomer, the above substance to be included in a thermally expandable microcapsule and a polymerization initiator are mixed together and the mixture is dispersed in an aqueous medium containing a surfactant or dispersion stabilizer, which is then subjected to suspension polymerization. Further, a compound having a reactive group which reacts with a functional group of a polymerizable monomer or an organic filler can be added thereto.

Examples of the polymerizable monomer are as follows, for example: acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, vinyl acetate, acrylates (methyl acrylate, ethyl acrylate, n-butyl acrylate, isobutyl acrylate, t-butyl acrylate, isobornyl acrylate, cyclohexyl acrylate and benzyl acrylate), methacrylates (methyl methacrylate, ethyl methacrylate, n-butyl methacrylate, isobutyl methacrylate, t-butyl methacrylate, isobornyl methacrylate, cyclohexyl methacrylate and benzyl methacrylate), styrene-based monomers, acrylamide, substituted acrylamide, methacrylamide, substituted methacrylamide, butadiene, ε-caprolactam, polyethers and isocyanates. One of these polymerizable monomers can be used singly, or two or more thereof can be used in combination.

The polymerization initiator is not particularly limited but is preferably an initiator soluble in a polymerizable monomer, and a known peroxide initiator and azo initiator can be used. Among them, an azo initiator is preferred. Examples of the azo initiator are as follows, for example: 2,2'-azobisisobutyronitrile, 1,1'-azobiscyclohexan-1-carbonitrile and 2,2'-azobis-4-methoxy-2,4-dimethylvaleronitrile. Among them, 2,2'-azobisisobutyronitrile is preferred. In the case that a polymerization initiator is used, the amount thereof to be used can be 0.01 to 5 parts by mass based on 100 parts by mass of a polymerizable monomer.

As the surfactant, an anionic surfactant, a cationic surfactant, a nonionic surfactant, an amphoteric surfactant or a polymer dispersant can be used. The amount of the surfactant to be used can be 0.01 to 10 parts by mass based on 100 parts by mass of a polymerizable monomer. Examples of the dispersion stabilizer are as follows, for example: organic fine particles (a polystyrene fine particle, a polymethyl methacrylate fine particle, a polyacrylic acid fine particle and a polyepoxide fine particle), silica (colloidal silica), calcium carbonate, calcium phosphate, aluminum hydroxide, barium carbonate and magnesium hydroxide. The amount of the dispersion stabilizer to be used can be 0.01 to 20 parts by mass based on 100 parts by mass of a polymerizable monomer.

Suspension polymerization can be performed in a sealed environment using a pressure resistant vessel. Further, a polymerizable raw material which has been suspended with a disperser may be transferred into a pressure resistant vessel for suspension polymerization, or a polymerizable raw material may be suspended in a pressure resistant vessel. The polymerization temperature can be 50° C. to 120° C. Polymerization may be performed at the atmospheric pressure, but preferably performed at an increased pressure (at a pressure equal to the atmospheric pressure plus a pressure of 0.1 to 1 MPa) in order not to gasify the above substance to be included in a thermally expandable microcapsule. After the completion of polymerization, solid-liquid separation and washing may be carried out by centrifugation or filtration. In the case that solid-liquid separation or washing is carried out, drying or pulverization may be carried out thereafter at a temperature lower than or equal to the softening point of the resin contained in the thermally expandable microcapsule. Drying and pulverization can be carried out by using a known method, and a flash dryer, a wind dryer and a Nauta mixer can be used therefor. Further, drying and pulverization can be carried out simultaneously by using a crushing and drying machine. The surfactant and dispersion stabilizer can be removed by repeating washing and filtration after production.

[Method for Forming Pre-Coating Layer]

Next, methods for forming a pre-coating layer will be described. Examples of the method for forming a pre-coating layer include a method in which an electro-conductive resin composition layer is formed on an electro-conductive substrate by using a coating method such as electrostatic spray coating, dip coating and roll coating and the layer is cured by drying, heating, crosslinking or the like. Another example of the method is a method in which a sheet-shaped or tube-shaped layer obtained by forming a film in a predetermined thickness with an electro-conductive resin composition followed by curing is bonded to an electro-conductive substrate or an electro-conductive substrate is coated with the layer. Further example of the method is a method in which an electro-conductive resin composition is placed in a mold with an electro-conductive substrate disposed therein followed by being cured to form a pre-coating layer. Particularly in the case that the binder is a rubber, a pre-coating layer can also be provided by integrally extruding an electro-conductive substrate and an unvulcanized rubber composition using an extruder provided with a crosshead. A crosshead is an extrusion mold for forming a coating layer on an electrical wire or a wire and is provided on the cylinder head of an extruder in use. Thereafter, the pre-coating layer is dried, cured or cross-linked, for example, and the surface thereof is then ground so that the shell of the hollow-shaped resin particle is partly removed into a bowl shape. A cylinder grinding method or a tape grinding method can be used for the grinding method. Examples of the cylinder grinder include a traverse type NC cylinder grinder and a plunge-cutting type NC cylinder grinder.

(a) In the case that the thickness of the pre-coating layer is five times the average particle diameter of the hollow-shaped resin particle or less In the case that the thickness of the pre-coating layer is five times the average particle diameter of the hollow-shaped resin particle or less, a protrusion derived from the hollow-shaped resin particle is formed on the surface of the pre-coating layer in many cases. In this case, the protrusion of the hollow-shaped resin particle can be partly removed into a bowl shape so as to form an uneven shape derived from the opening of the bowl-shaped resin particle. In this case, a tape grinding method can be used, in which the pressure applied on the pre-coating layer in grinding is relatively small. As an example, preferred conditions for grinding the pre-coating layer using a tape grinding method are shown in the following.

An abrasive tape is a tape obtained by applying a resin in which an abrasive grain is dispersed onto a sheet-like base material. Examples of the abrasive grain include aluminum oxide, chromium oxide, iron oxide, diamond, cerium oxide, corundum, silicon nitride, silicon carbide, molybdenum carbide, tungsten carbide, titanium carbide and silicon oxide. The average particle diameter of the abrasive grain is preferably 0.01 μm or more and 50 μm or less, and more preferably 1 μm or more and 30 μm or less. The above average particle diameter of the abrasive grain is a median diameter D50 measured using a centrifugal settling method. The grit No. of the abrasive tape having the abrasive grain in the above preferred range is preferably in a range of 500 or more and 20000 or less, and more preferably 1000 or more and 10000 or less.

Specific examples of the abrasive tape are as follows, for example: "MAXIMA LAP, MAXIMA T type" (trade name, Ref-Lite Co., Ltd.), "Lapika" (trade name, manufactured by KOVAX Corporation), "Micro Finishing Film", "Wrapping Film" (trade name, Sumitomo 3M Limited (new company name: 3M Japan Limited)), Mirror Film, Wrapping Film (trade name, manufactured by Sankyo-Rikagaku Co., Ltd.) and Mipox (trade name, manufactured by Mipox Corporation (old company name: Nihon Micro Coating Co., Ltd.)).

The feed speed for the abrasive tape is preferably 10 mm/min or more and 500 mm/min or less, and more preferably 50 mm/min or more and 300 mm/min or less. The pressing pressure of the abrasive tape on the pre-coating layer is preferably 0.01 MPa or more and 0.4 MPa or less, and more preferably 0.1 MPa or more and 0.3 MPa or less. In order to control the pressing pressure, a backup roller may be brought into contact with the pre-coating layer via the abrasive tape. Further, a grinding treatment may be carried out several times in order to obtain a desired shape. The rotational frequency is preferably set to 10 rpm or more and 1000 rpm or less, and more preferably set to 50 rpm or more and 800 rpm or less. The above conditions enable to form an uneven shape derived from the opening of a bowl-shaped resin particle on the surface of the pre-coating layer more easily. Even in the case that the thickness of the pre-coating layer is outside of the above range, an uneven shape derived from the opening of a bowl-shaped resin particle can be formed by using the method (b) described below.

(b) In the case that the thickness of the pre-coating layer is more than five times the average particle diameter of the hollow-shaped resin particle In the case that the thickness of the pre-coating layer is more than five times the average particle diameter of the hollow-shaped resin particle, no protrusion derived from the hollow-shaped resin particle may be formed on the surface of the pre-coating layer in some cases. In such a case, an uneven shape derived from the opening of a bowl-shaped resin particle can be formed by utilizing the difference in grinding properties between the hollow-shaped resin particle and the material for the pre-coating layer. The hollow-shaped resin particle includes a gas inside, and therefore has a high impact resilience. In response to this fact, a rubber or resin having a relatively small impact resilience and a small elongation is selected as the binder for the pre-coating layer. This selection enables to achieve a state in which the pre-coating layer can be well ground and the hollow-shaped resin particle is poorly ground. By grinding the pre-coating layer in the above state, the shell of the hollow-shaped resin particle can be partly removed into a bowl shape without being ground in the same state as the pre-coating layer. Thereby, an uneven shape derived from the opening of the bowl-shaped resin particle can be formed on the surface of the pre-coating layer. Because this method is a method utilizing the difference in grinding properties between the hollow-shaped resin particle and the material for the pre-coating layer to form an uneven shape, the material (binder) used for the pre-coating layer can be a rubber. Among rubbers, an acrylonitrile-butadiene rubber, a styrene-butadiene rubber or a butadiene rubber is particularly preferably used from the viewpoint of small impact resilience and small elongation.

[Grinding Method]

Although a cylinder grinding method or a tape grinding method can be used for the grinding method, conditions for quicker grinding are preferred because it is needed to derive the difference in grinding properties between materials significantly. From this viewpoint, a cylinder grinding method is more preferably used. Among cylinder grinding methods, a plunge-cutting method is still more preferably used from the viewpoint of enabling to grind the pre-coating layer in the longitudinal direction simultaneously and to shorten the grinding time. Further, it is preferred to carry out a spark-out process (a grinding process at an intrusion speed of 0 mm/min), which has been conventionally carried out from the viewpoint of uniforming the ground surface, for as short time as possible, or not to carry out a spark-out process. As an example, the rotational frequency of a cylindrical grinding wheel used for the plunge-cutting method is preferably 1000 to 4000 rpm, and particularly preferably 2000 to 4000 rpm. The intrusion speed into the pre-coating layer is preferably 5 to 30 mm/min, and particularly preferably 10 to 30 mm/min. At the last of an intrusion process, a conditioning process may be carried out for the ground surface, and the conditioning process can be carried out at an intrusion speed of 0.1 mm/min or more and 0.2 mm/min or less for within 2 seconds. A spark-out process (a grinding process at an intrusion speed of 0 mm/min) can be carried out for 3 seconds or shorter. The rotational frequency is preferably set to 50 rpm or more and 500 rpm or less, and more preferably set to 200 rpm or more. The above conditions enable to form an uneven shape derived from the opening of a bowl-shaped resin particle on the surface of the pre-coating layer more easily.

In the following description, the ground pre-coating layer is simply referred to as "coating layer".

[Method for Controlling Electroconductivity]

The charging member satisfies expressions (1) to (3). Each of K1 to K3 in expressions (1) to (3) denotes the brightness due to the electroconductivity of a site in the surface of the charging member. In order to satisfy expressions (1) to (3), the electroconductivity of each site in the "coating layer" can be controlled.

First, in order to satisfy expressions (1) and (2), a low-electroconductivity resin having a volume resistivity of $10^{10}$ Ωcm or more is employed as the material of the bowl portion of the above-described bowl-shaped resin particle. Next, in order to satisfy expression (3), the electroconductivity of the binder in the coating layer and the electroconductivity of the concavity derived from the bowl-shaped resin particle can be controlled. The above control of electroconductivity can be performed in a process after the above-described grinding process, and the controlling method will be described in detail in the following.

Figure 8:
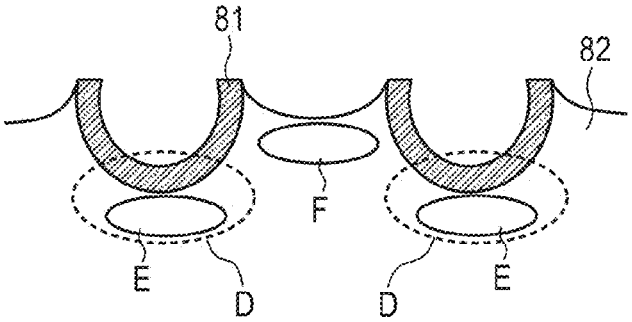
FIG. 8 is a schematic cross-sectional view illustrating one aspect of the charging member according to the present invention.

The state after the grinding process is illustrated in FIG. 8. First, as described above, the bowl-shaped resin particle 81 can be formed with a low-electroconductivity material or an insulating material so that a state is achieved in which the concavity D derived from the bowl-shaped resin particle in FIG. 8 has a lower electroconductivity than the electroconductivity of the binder portion F beside the bowl-shaped resin particle.

Next, examples of the method for controlling the electroconductivity of the coating layer in order to satisfy expression (3) after the above grinding process include the following three methods.

[Method 1] A method in which an electro-conductive fine particle is allowed to be present at a surface of the concavity derived from the bowl-shaped resin particle.

[Method 2] A method in which the surface of the coating layer is heat-treated in an oxygen-containing atmosphere (e.g., in the atmosphere) using a material having a low oxygen transmission rate of 140 $cm^3/(m^2 \cdot 24\ h \cdot atm)$ or less for the material of the bowl-shaped resin particle.

[Method 3] A method in which a silicone oil is localized on the electro-conductive resin layer included in a part of the surface of the electrophotographic member.

Figure 9:
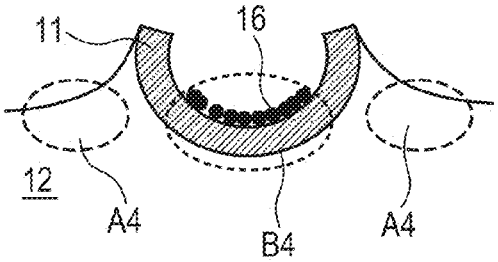
FIG. 9 is a schematic cross-sectional view illustrating one aspect of the charging member according to the present invention.

The above [Method 1] is now described using FIG. 9. The electroconductivity of the concavity (B4) derived from the bowl-shaped resin particle in FIG. 9 can be increased by applying an electro-conductive fine particle at a surface of the concavity derived from the bowl-shaped resin particle. Further, selecting the type of an electro-conductive fine particle to be applied enables to control the value of K2/K3 within the range satisfying expression (3). Here, although the above-described electro-conductive fine particle can be used as an electro-conductive fine particle to be applied, the electro-conductive fine particle to be used is preferably an electro-conductive fine particle having a volume resistivity of $10^{0}$ to $10^{8}$ Ω·cm, and more preferably an electro-conductive fine particle having a volume resistivity of $10^{2}$ to $10^{5}$ Ω·cm. Note that the resin used for the binder is not particularly limited.

Figure 10A:
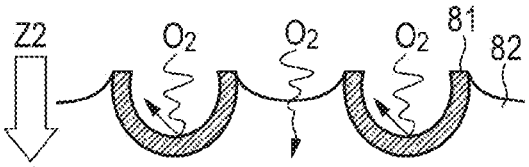
FIGS. 10A and 10B are diagrams illustrating the situation of oxygen transmission in heat treatment in one aspect of the method for producing a charging member according to the present invention.
Figure 10B:
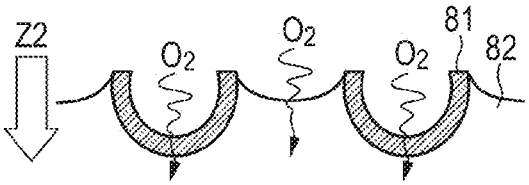

The above [Method 2] is now described using FIGS. 8, 10A and 10B. In a heat treatment in an oxygen-containing atmosphere, oxidative crosslinking progresses to increase the degree of crosslinking of a resin. Along with this increase, the electroconductivity of the resin tends to be lowered. This phenomenon is due to that the molecular mobility is lowered as oxidative crosslinking progresses. The degree of oxidative crosslinking can be adjusted with the heat treatment temperature and the oxygen concentration in the crosslinking portion. Regarding the heating temperature, the higher the temperature, the higher the degree of crosslinking; and regarding the oxygen concentration, the higher the oxygen concentration in the crosslinking portion, the more oxidative crosslinking can progress. Accordingly, the electroconductivity of the binder portion F beside the bowl-shaped resin particle and the electroconductivity of the site E immediately beneath the bowl-shaped resin particle in FIG. 8 can be controlled by controlling the above heating temperature and oxygen concentration in the resin. In this case, for a method for controlling the oxygen concentration in the resin it is effective to adjust the oxygen transmission rate of the bowl of the bowl-shaped resin particle.

In a common heat treatment, oxidative crosslinking progresses from the surface of the coating layer to the inward direction of the coating layer (the arrow Z2 direction in FIGS. 10A and 10B). In the case that the oxygen transmission rate of the bowl-shaped resin particle is low, the oxygen transmission is interrupted by the bowl-shape resin particle 81 as illustrated in FIG. 10A, and therefore the oxidative crosslinking in the site E is suppressed compared with the oxidative crosslinking in the site F in FIG. 8. As a result, the electroconductivity of the site E is higher than the electroconductivity of the site F. Accordingly, the value of the electroconductivity of the site D and the value of the electroconductivity of the site F tend to be close to each other, and the value of K2/K3 in expression (3) becomes close to 1.

On the other hand, in the case that the oxygen transmission rate of the bowl-shaped resin particle is high, the bowl-shape resin particle 81 allows for oxygen transmission as illustrated in FIG. 10B so that oxygen is also supplied to the site E in FIG. 8, and therefore the oxidative crosslinking in the site E progresses in the same way in the site F. As a result, the value of the electroconductivity of the site E and the value of the electroconductivity of the site F are almost equal. The value of the electroconductivity of the site D and the value of the electroconductivity of the site F in FIG. 8 do not become close to each other even after being subjected to a heat treatment in the atmosphere, and therefore the value of K2/K3 in expression (3) does not become close to 1.

As described above, for a method for controlling electroconductivity it is effective to form the bowl of the bowl-shaped resin particle with a material having a low oxygen transmission rate.

Accordingly, it is preferred to use an acrylonitrile resin, a vinylidene chloride resin, a methacrylonitrile resin, a methyl methacrylate resin or a copolymer of these resins, each of which has a low oxygen gas transmission rate, and it is particularly preferred to use an acrylonitrile resin or a vinylidene chloride resin. By doing so, the above control of electroconductivity can be performed more easily.

In addition, it is also an effective method for controlling the above electroconductivity to change the temperature in a heat treatment because the degree of oxidative crosslinking can be controlled. However, although the above progression of oxidative crosslinking due to heating is accelerated at a higher temperature, shrinkage simultaneously occurs owing to the volatilization of a low-molecular weight component in the binder, for example. When the above phenomenon occurs, the electro-conductive fine particles dispersed in the binder tend to be densely repositioned to significantly increase the electroconductivity of the surface of the charging member, and as a result expression (3) may be unsatisfied. Therefore, it can be said that the heating temperature is preferably controlled to 180 to 210° C., and more preferably 190 to 200° C.

As the method for heat treatment, a known device can be used such as a continuous hot air furnace, an oven, a near infrared ray heating method and a far infrared ray heating method, but the method is not limited to these methods as long as the method enables to heat-treat the surface of the coating layer in an oxygen-containing atmosphere (in the presence of oxygen).

For a resin as the binder, a resin in which the effect of oxidative crosslinking is accelerated in being heated in an oxygen-containing atmosphere can be used. Specifically, a styrene-butadiene rubber (SBR), a butyl rubber, an acrylonitrile-butadiene rubber (NBR), a chloroprene rubber (CR) or a butadiene rubber (BR), each of which has a double bond in the molecule and has a high heat resistance, can be used. The electro-conductive resin layer can be an electro-conductive resin layer containing a crosslinked rubber as a binder and being formed by thermally crosslinking an electro-conductive, thermally crosslinkable rubber composition containing an electro-conductive fine particle in the presence of oxygen.

Figure 14:
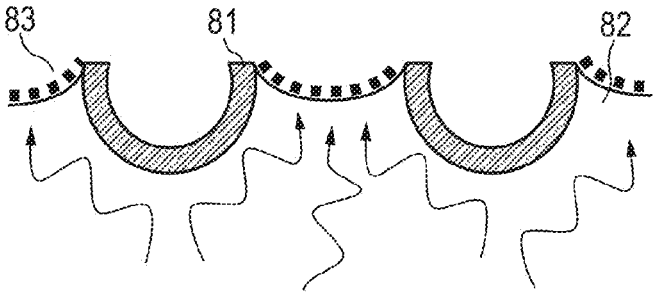
FIG. 14 is a schematic cross-sectional view illustrating still another aspect of the charging member according to the present invention.

The above [Method 3] is now described using FIG. 14. In the case that a silicone oil is added to an electro-conductive resin layer and thereafter the electro-conductive resin layer is heated, the molecular mobility of the binder in the electro-conductive resin layer is enhanced and the silicone oil is transferred onto the outermost surface of the electro-conductive resin layer. Here, in the case that the gas permeability of the bowl-shaped resin particle is low, the silicone oil cannot be transferred to the concavity of the bowl and is selectively transferred to the binder portion beside the bowl-shaped resin particle.

The above method enables to localize a silicone oil on the electro-conductive resin layer included in a part of the surface of the electrophotographic member. Because a silicone oil has high insulation properties, the electroconductivity of the binder portion on which a silicone oil is localized tends to be lowered to be close to the electroconductivity of the concavity of the bowl, and as a result the value K2/K3 in expression (3) becomes close to 1.

Regarding the type of a silicone oil, although a known silicone oil can be used, dimethylpolysiloxane is preferred from the viewpoint of being easily transferred onto the surface, and linear dimethylpolysiloxane is more preferred.

Further, the silicone oil preferably has a viscosity at a room temperature (25° C.) of 200 $mm^2/s$ or less, and more preferably 100 $mm^2/s$ or less, and preferably 20 $mm^2/s$ or more, and more preferably 30 $mm^2/s$ or more. Using a silicone oil having such a range of viscosity enables to more satisfactorily transfer the silicone oil to the surface side by heating the electro-conductive resin layer. Then, the gasification of the silicone oil can also be suppressed effectively.

As described above, for the bowl-shaped resin particle, it is preferred to use an acrylonitrile resin, a vinylidene chloride resin, a methacrylonitrile resin, a methyl methacrylate resin or a copolymer of these resins, each of which has a low gas permeability, and it is particularly preferred to use an acrylonitrile resin or a vinylidene chloride resin.

For a method for transferring the silicone oil onto the outermost surface of the electrophotographic member efficiently, an NBR, a rubber with a poor compatibility with silicone oils, can be used as the binder used for the electro-conductive resin layer.

Further, transfer of the silicone oil onto the outermost surface can be carried out simultaneously with the above [Method 2] by heating the electro-conductive resin layer in an oxygen-containing atmosphere.

Hereinabove, the method for forming an electro-conductive resin layer has been described, and examples of the method for producing an electrophotographic member according to the present invention are as in the following [1] to [5].

[1] A method for producing an electrophotographic member including: forming a coating layer of a composition containing a hollow-shaped resin particle dispersed in a binder on an electro-conductive substrate; grinding the surface of the coating layer to partly remove the shell of the hollow-shaped resin particle into a bowl shape having an opening so as to form a concavity derived from the opening of the bowl-shaped resin particle and a protrusion derived from the edge of the opening; and allowing an electro-conductive fine particle to be present in the concavity.

[2] A method for producing an electrophotographic member including regrinding the surface of the coating layer after the allowing an electro-conductive fine particle to be present.

[3] A method for producing an electrophotographic member including: forming a coating layer of a thermally crosslinkable rubber composition containing an electro-conductive fine particle, a thermally crosslinkable rubber and a hollow-shaped resin particle; grinding the surface of the coating layer to partly remove the shell of the hollow-shaped resin particle into a bowl-shaped resin particle having an opening and forming a layer retaining the bowl-shaped resin particle so that the opening is exposed at the surface; and thermally crosslinking the thermally crosslinkable rubber in the coating layer in the presence of oxygen to obtain an electrophotographic member having a concavity derived from the opening and a protrusion derived from the edge of the opening on the surface, wherein a part of the surface includes the electro-conductive resin layer.

[4] The method for producing an electrophotographic member according to any one of the [1] to [3], wherein the oxygen transmission rate of the shell of the hollow-shaped resin particle is 140 $cm^3/(m^2 \cdot 24\ h \cdot atm)$ or less.

[5] The method for producing an electrophotographic member according to any one of the [1] to [4], wherein the volume resistivity of the shell of the hollow-shaped resin particle is $10^{10}$ Ωcm or more.

[Calculation of Brightness Due to Electroconductivity]

Figure 11A:
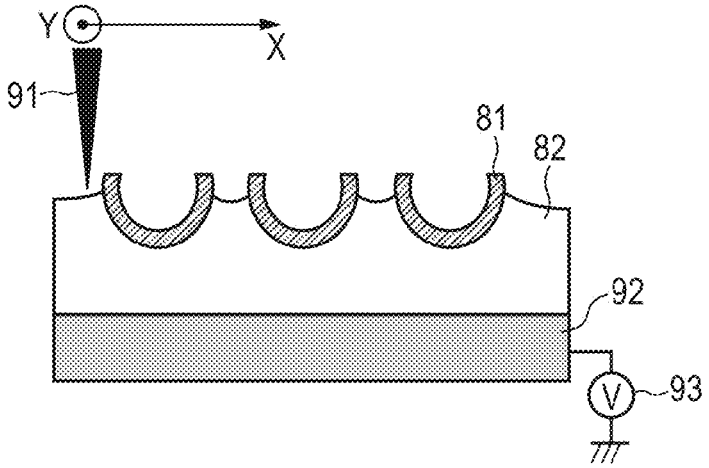
FIGS. 11A, 11B and 11C are schematic diagrams illustrating one embodiment of a scanning electron microscope for calculating brightness due to electroconductivity.

A method for evaluating a charging member using brightness due to the above-described electroconductivity will be described in the following. FIG. 11A is a schematic diagram illustrating one embodiment of a scanning electron microscope for calculating the brightness due to the electroconductivity of a concave or protrusion.

The reference sign 93 refers to a power supply to apply a positive electrical potential to an electro-conductive substrate 92. While a predetermined electrical potential is applied to the electro-conductive substrate 92, an electron beam 91 is irradiated from the surface of the charging member on each point on the surface at an accelerating voltage which allows the electron beam to penetrate only into the vicinity of the surface. The irradiation position of the electron beam 91 continuously scans the XY plane (Y is the direction perpendicular to the paper surface) in FIG. 11A. The electron beam 91 irradiated on the surface of the charging member allows a secondary electron to be discharged. The number of secondary electrons measured is converted to contrast information, which is mapped in association with the irradiation position of the electron beam for imaging to obtain a secondary electron image.

In the case that a positive electrical potential is applied to the electro-conductive substrate 92 by the power supply 93, the number of secondary electrons then generated from the surface of the charging member by the electron beam irradiation causes the following phenomenon [1] or [2] depending on the electroconductivity of the site irradiated with the electron beam.

Figure 11B:
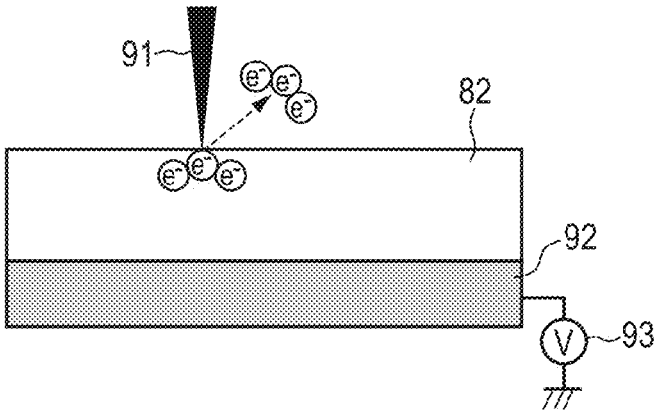
Figure 11C:
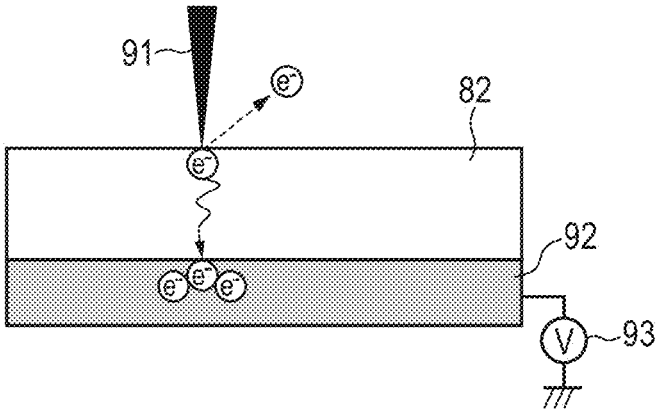

[1] In the case that the electroconductivity of the site irradiated with the electron beam is high (FIG. 11C)

The secondary electron generated by the electron beam irradiation is attracted to the electro-conductive substrate having a positive electrical potential, and as a result the number of secondary electrons detected by using a detector decreases.

[2] In the case that the electroconductivity of the site irradiated with the electron beam is low (FIG. 11B)

The above attraction of the secondary electron to the electro-conductive substrate having a positive electrical potential is suppressed, and as a result the number of secondary electrons detected by using a detector increases compared with the case of the [1].

For the above reason, the contrast obtained by converting the number of secondary electrons measured varies depending on the electroconductivity of the site irradiated with the electron beam, and therefore the electroconductivity of the site irradiated with the electron beam can be estimated by using the brightness of the secondary electron image. Specifically, the smaller the brightness, the smaller the number of secondary electrons detected by using a detector, as described above, that is, which indicates that the site has a high electroconductivity. The larger the brightness, the larger the number of secondary electrons measured, that is, which indicates that the site has a low electroconductivity.

In the present invention, using a scanning electron microscope capable of obtaining the above contrast image due to electroconductivity, the brightness K1 of the protrusion (C1) of the bowl on the surface of the charging member in FIG. 1A, the brightness K2 of the bottom (B3) of the concavity of the bowl and the brightness K3 of the binder (A3) exposed at the surface are calculated. In obtaining the above contrast image due to electroconductivity, it is effective to apply a voltage to an object to be observed, and observation can be carried out using an apparatus obtained by customizing a scanning electron microscope so that a DC power supply can be connected thereto via a vacuum feedthrough. Here, a "vacuum feedthrough" is a vacuum part of equipment inside of which a vacuum is maintained and is attached on a vacuum wall separating the vacuum from the atmosphere in order to control electrical signals, physical motion and transportation of a fluid or the like.

The observation conditions will be described in the following. The positive electrical potential to be applied to the electro-conductive substrate is needed to be within 50 to 100 V. The reason is that the voltage applied to a charging member in forming an image is generally within the above range and the contrast correlates with an output image.

The accelerating voltage for the electron beam is needed to be 1 kV. In the case that the accelerating voltage is lower than 1 kV, most of the electrons cannot transmit through the bowl-shaped resin particle 11 in FIG. 1A, and as a result the brightness K2 due to the above-described electroconductivity of a site including the bowl-shaped resin particle and the binder portion immediately beneath the bowl-shaped resin particle cannot be calculated accurately. In the case that the accelerating voltage for the electron beam is higher than 1 kV, most of the electrons transmit to the binder portion immediately beneath the bowl-shaped resin particle, and as a result the brightness K2 due to the above-described electroconductivity of a site including the bowl-shaped resin particle and the binder portion immediately beneath the bowl-shaped resin particle cannot be calculated accurately.

In calculating the values of brightness K1 to K3 accurately, the contrast and brightness of a scanning electron microscope have a large influence. Therefore, in the present invention, the contrast and brightness of a scanning electron microscope is preferably 45% or more and 55% or less and 25% or more and 30% or less, respectively, and more preferably 50% and 28%, respectively.

<Electrophotographic Apparatus>

Figure 12:
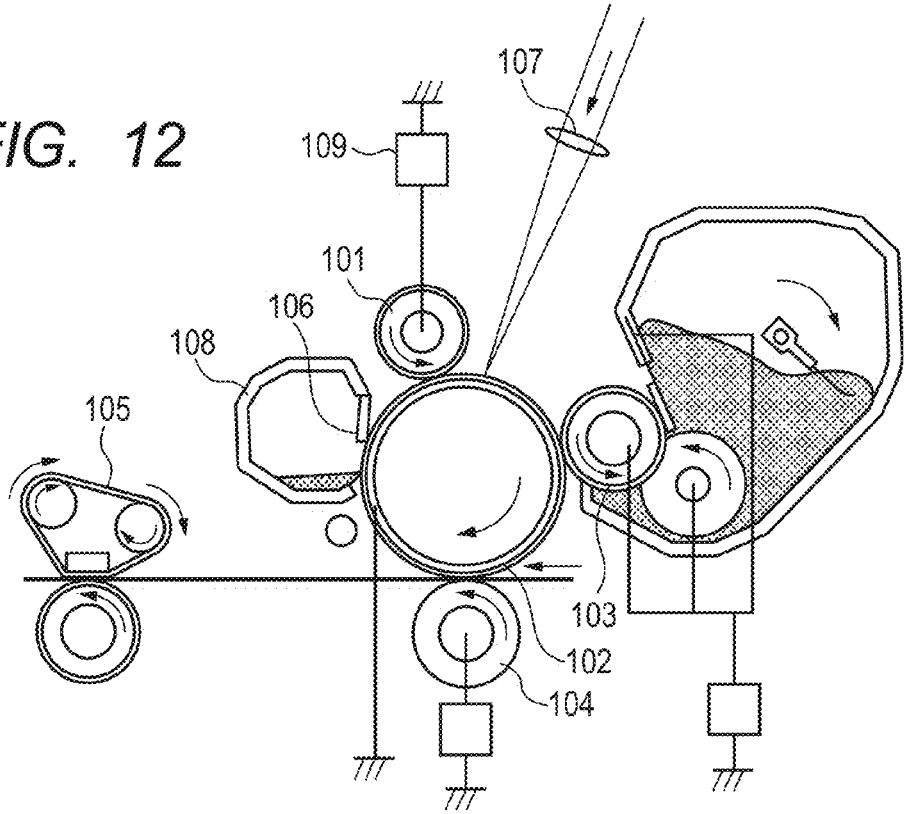
FIG. 12 is a schematic cross-sectional view illustrating one example of the electrophotographic apparatus according to the present invention.

A schematic configuration of one example of the electrophotographic apparatus according to the present invention is illustrated in FIG. 12. This electrophotographic apparatus includes an electrophotographic photosensitive member, a charging device to charge the electrophotographic photosensitive member, a latent image-forming device to expose, a developing device to develop into a toner image, a transfer device to transfer onto a transfer medium, a cleaning device to collect a toner remained on the electrophotographic photosensitive member even after a transfer step at the transfer device, a fixing device to fix the toner image, and so on.

The electrophotographic photosensitive member 102 is a rotary drum type one having a photosensitive layer on an electro-conductive substrate. The electrophotographic photosensitive member is rotationally driven to the direction of the arrow at a predetermined rotational speed (process speed).

The charging device has a contact charging roller 101 which is brought into contact with the electrophotographic photosensitive member 102 at a predetermined pressing pressure to be disposed in contact therewith. The charging roller 101, a driven-rotary type one which rotates following the rotation of the electrophotographic photosensitive member 102, is applied with a predetermined DC voltage by a power supply for charging 109 to charge the electrophotographic photosensitive member 102 to a predetermined electrical potential. As the latent image-forming device (not illustrated) to form an electrostatic latent image on the electrophotographic photosensitive member 102, an exposing device such as a laser beam scanner is used. The uniformly charged electrophotographic photosensitive member 102 is irradiated with an exposure light 107 corresponding to image information to form an electrostatic latent image.

The developing device has a developing sleeve or a developing roller 103 disposed adjacent to or in contact with the electrophotographic photosensitive member 102. The developing device develops the electrostatic latent image to form a toner image by reversal development using a toner electrostatically treated into the same polarity as the charged polarity of the electrophotographic photosensitive member. The transfer device has a contact transfer roller 104. The transfer device transfers the toner image from the electrophotographic photosensitive member onto a transfer medium such as a plain paper. The transfer medium is conveyed by a paper feeding system including a conveying member.

The cleaning device, which has a blade type cleaning member 106 and a collection container 108, mechanically scrapes off and collects a transfer residual toner remaining on the electrophotographic photosensitive member 102 after the developed toner image is transferred onto the transfer medium. Here, the cleaning device can even be omitted by employing a cleaning-at-development method, in which a transfer residual toner is collected in a developing device. The toner imager transferred onto the transfer medium passes through between a fixing belt 105 heated with a non-illustrated heating apparatus and a roller disposed opposite to the fixing belt and as a result fixed onto the transfer medium.

<Process Cartridge>

Figure 13:
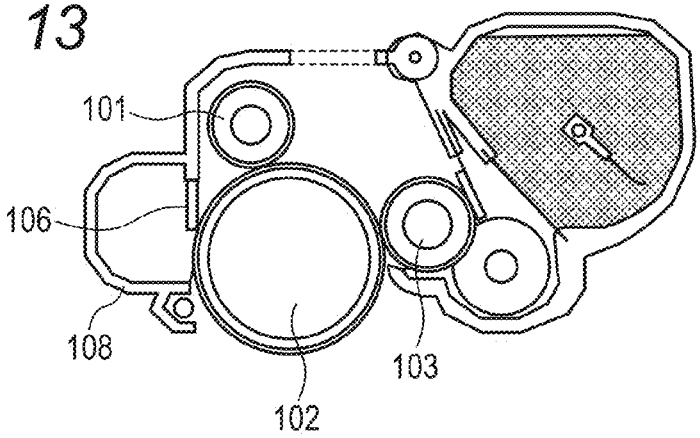
FIG. 13 is a schematic cross-sectional view representing one example of the process cartridge according to the present invention.

A schematic configuration of one example of a process cartridge is illustrated in FIG. 13. This process cartridge integrates an electrophotographic photosensitive member 102, a charging roller 101, a developing roller 103, a cleaning member 106 and so on and is configured to be attachable to and detachable from the main body of an electrophotographic apparatus.

According to one embodiment of the present invention, a charging member can be provided which suppresses the nonuniform abrasion of a photosensitive member and can provide a high-quality electrophotographic image even in an electrophotographic apparatus with an increased speed. Further, according to the present invention, a process cartridge and an electrophotographic apparatus which contribute to forming a high-quality electrophotographic image stably are provided.

EXAMPLES

Hereinafter, the present invention will be described in more detail by giving specific Production Examples and Examples. Prior to Examples, Production Examples 1 to 8 (production of resin particles 1 to 8), a method for measuring the volume average particle diameter of a resin particle, Production Examples 11 to 16 (production of sheets for measuring gas transmission rate 1 to 6), a method for measuring the oxygen gas transmission rate of a resin particle and Production Examples 21 to 41 (production of electro-conductive rubber compositions 1 to 21) are described. Note that parts and % in the following Examples and Comparative Examples are all based on mass unless otherwise specified.

Production Example 1

Production of Resin Particle No. 1

An aqueous mixed solution was prepared containing 4000 parts by mass of ion-exchanged water, 9 parts by mass of colloidal silica as a dispersion stabilizer and 0.15 parts by mass of polyvinylpyrrolidone. Then, an oily mixed solution was prepared containing 50 parts by mass of acrylonitrile, 45 parts by mass of methacrylonitrile and 5 parts by mass of methyl acrylate as polymerizable monomers, and 12.5 parts by mass of n-hexane as an included substance, and 0.75 parts by mass of dicumyl peroxide as a polymerization initiator. This oily mixed solution was added to the aqueous mixed solution and 0.4 parts by mass of sodium hydroxide was further added thereto to prepare a dispersion.

The obtained dispersion was stirred to mix together with a homogenizer for 3 minutes, charged into a polymerization reactor which had been purged with nitrogen, and reacted at 60° C. for 20 hours while stirring at 400 rpm to prepare a reaction product. The obtained reaction product was subjected to filtration and washing with water repeatedly, and then dried at 80° C. for 5 hours to produce resin particles. These resin particles were cracked and classified with a sonic classifier to afford resin particle No. 1.

Production Example 2

Production of Resin Particle No. 2

Resin particle No. 2 was produced with the same method as in Production Example 1 except that classifying conditions were changed.

Production Examples 3 to 8

Production of Resin Particles Nos. 3 to 8

Resin particles were produced with the same method as in Production Example 1 except that one or more of the amount of colloidal silica used, the type and amount of a polymerizable monomer used, and the rotational frequency for stirring in polymerization were changed, and classified to afford resin particles Nos. 3 to 8.

<Measurement for Volume Average Particle Diameter of Resin Particle>

The volume average particle diameter of each of resin particles Nos. 1 to 8 was measured using a laser diffraction particle size analyzer (trade name: Coulter LS-230 Particle Size Analyzer, manufactured by Beckmann Coulter, Inc.).

For the measurement, an aqueous module was used and pure water was used as the solvent for measurement. After the inside of the measuring system of the particle size analyzer was washed with pure water for about 5 minutes, 10 to 25 mg of sodium sulfite as an antifoamer was added into the measuring system and a background function was executed. Subsequently, 3 to 4 drops of a surfactant was added into 50 mL of pure water, and 1 mg to 25 mg of a sample to be measured was further added thereto. The aqueous solution with the sample suspended therein was dispersed with an ultrasonic disperser for 1 minute to 3 minutes to prepare a sample solution to be tested. The sample solution to be tested was gradually added into the measuring system of the measuring apparatus, and after the concentration of the sample to be tested in the measuring system was adjusted so that PIDS on the display of the apparatus was 45% or more and 55% or less, measurement was performed. The volume average particle diameter was calculated from the obtained volume distribution.

The formulations of materials, stirring conditions in polymerization and volume average particle diameters of respective resin particles Nos. 1 to 8 are shown in Table 1.

TABLE 1

| Production Example | Resin particle No. | Amount of colloidal silica used [parts by mass] | Polymerizable monomer and amount thereof used [parts by mass] | Rotational frequency for stirring [rpm] | Volume average particle diameter [μm] |
|---|---|---|---|---|---|
| 1 | 1 | 9 | Acrylonitrile 50-methacrylonitrile 45-methyl acrylate 5 | 400 | 30 |
| 2 | 2 | 9 | Acrylonitrile 50-methacrylonitrile 45-methyl acrylate 5 | 400 | 15 |
| 3 | 3 | 4.5 | Acrylonitrile 50-methacrylonitrile 45-methyl acrylate 5 | 400 | 50 |
| 4 | 4 | 9 | Acrylonitrile 80-methacrylonitrile 20 | 400 | 28 |
| 5 | 5 | 4.5 | Acrylonitrile 100 | 400 | 25 |
| 6 | 6 | 9 | Methyl methacrylate 100 | 250 | 40 |
| 7 | 7 | 9 | Vinylidene chloride 100 | 400 | 25 |
| 8 | 8 | 4.5 | Polybutadiene 100 | 300 | 60 |

Production Example 11

Production of Sheet for Measuring Gas Transmission Rate No. 1

The sheet in this Production Example is a sheet for measuring the gas transmission rate of a resin material obtained by removing an included substance from a resin particle. Resin particle No. 1 was heated and decompressed at 100° C. for removing the included substance to afford resin composition No. 1. Thereafter, a metal mold (ϕ70 mm, 500 μm in depth) heated to 160° C. was filled with the resin composition, and pressurized at a pressure of 10 MPa to obtain a circular sheet for measuring gas transmission rate No. 1 having a diameter of 70 mm and a thickness of 500 μm.

Production Examples 12 to 16

Production of Sheets for Measuring Gas Transmission Rate Nos. 2 to 6

Sheets for measuring gas transmission rate Nos. 2 to 6 were obtained with the same method as above using resin particles Nos. 4 to 8, respectively, in place of resin particle No. 1.

<Measurement for Oxygen Gas Transmission Rate of Sheet>

Using each of the sheets for measuring gas transmission rate Nos. 1 to 6, the oxygen gas transmission rate was measured according to the differential-pressure method described in JIS K 7126 under the following conditions:

Measuring apparatus: gas transmission rate tester (trade name: M-C3, manufactured by Toyo Seiki Seisaku-Sho, Ltd.)

Gas used: oxygen gas corresponding to JIS K 1101

Measuring temperature: 23±0.5° C.

Test pressure: 760 mmHg

Permeation area: 38.46 $cm^2$ (ϕ70 mm)

Sample thickness: 500 μm.

Specific operations are as follows. First, a sheet for measuring gas transmission rate is installed in a transmission cell, and fixed at a uniform pressure so as not to cause an air leakage. The low pressure side and high pressure side in the measuring apparatus were evacuated, and then the evacuation in the low pressure side was stopped and kept vacuum. Thereafter, an oxygen gas was introduced into the high pressure side at 1 atm, and the pressure of the high pressure side at this time was defined as Pu. After the pressure of the low pressure side began to increase and it was confirmed that the oxygen gas was transmitted, a transmission curve (horizontal axis: time, vertical axis: pressure) was drawn and measurement was continued until a straight line, an indication of a steady state transmission, was confirmed. After the completion of the measurement, defining the gradient of the transmission curve as $d_p/d_t$, the oxygen gas transmission rate GTR ($cm^3/(m^2 \cdot 24\ h \cdot atm)$) was calculated using the following expression (9).

$$GTR = \frac{273 \times Vc \times 24}{T \times A \times P_u} \frac{d_p}{d_t} \qquad \text{Expression (9)}$$

(Vc: low pressure side volume ($cm^3$), T: test temperature (K), Pu: pressure of high pressure side (mmHg)).

The values of oxygen gas transmission rate of the sheets for measuring oxygen gas transmission rate Nos. 1 to 6 using resin particles Nos. 1 and 4 to 8, respectively, are shown in Table 2.

TABLE 2

| Production Example | Sheet No. for measuring gas transmission rate | Resin particle No. | Oxygen gas transmission rate [$cm^3/(m^2 \cdot 24\ h \cdot atm)$] |
|---|---|---|---|
| 11 | 1 | 1 | 44 |
| 12 | 2 | 4 | 30 |
| 13 | 3 | 5 | 13 |
| 14 | 4 | 6 | 140 |
| 15 | 5 | 7 | 16 |
| 16 | 6 | 8 | 29600 |

Production Example 21

Production of Electro-Conductive Rubber Composition No. 1

To 100 parts by mass of an acrylonitrile-butadiene rubber (NBR) (trade name: N230SV, manufactured by JSR Corporation), other materials listed in the column "Component (1)" in Table 3 were added, and the resultant was kneaded using a sealed mixer with the temperature controlled to 50° C. for 15 minutes. To this kneaded product, materials listed in the column "Component (2)" in Table 3 were added. The resultant was then kneaded using a two-roll mill cooled to a temperature of 25° C. for 10 minutes to obtain electro-conductive rubber composition No. 1.

TABLE 3

| | Material | Amount used (parts by mass) |
|---|---|---|
| Component (1) | Acrylonitrile-butadiene rubber (NBR) (trade name: N230SV, manufactured by JSR Corporation) | 100 |
| | Carbon black (trade name: TOKABLACK #7360SB, manufactured by Tokai Carbon Co., Ltd.) | 48 |
| | Zinc oxide (trade name: Zinc Oxide No. 2, manufactured by Sakai Chemical Industry Co., Ltd.) | 5 |
| | Zinc stearate (trade name: SZ-2000, manufactured by Sakai Chemical Industry Co., Ltd.) | 1 |
| | Calcium carbonate (trade name: NANOX#30, manufactured by Maruo Calcium Co., Ltd.) | 20 |
| Component (2) | Resin particle No. 1 | 12 |
| | Sulfur (vulcanizing agent) | 1.2 |
| | Vulcanization accelerator tetrabenzylthiuram disulfide (trade name: PERKACIT TBzTD, manufactured by Performance Additives; hereinafter, sometimes abbreviated as "TBzTD") | 4.5 |

Production Examples 22 to 27 and 30

Production of Electro-Conductive Rubber Compositions Nos. 2 to 7 and 10

Electro-conductive rubber compositions Nos. 2 to and 10 were obtained in the same way as in Production Example 21 except that, in Production Example 21, the resin particle 1 was changed to the respective resin particles (resin particle Nos. 2 to 8) listed in Table 7.

Production Example 28

Production of Electro-Conductive Rubber Composition No. 8

To 100 parts by mass of a styrene-butadiene rubber (SBR) (trade name: Tufdene 2003, manufactured by Asahi Kasei Chemicals Corporation), other materials listed in the column "Component (1)" in Table 4 were added, and the resultant was kneaded using a sealed mixer with the temperature controlled to 80° C. for 15 minutes. To this kneaded product, materials listed in the column "Component (2)" in Table 4 were added. The resultant was then kneaded using a two-roll mill cooled to a temperature of 25° C. for 10 minutes to obtain electro-conductive rubber composition No. 8.

TABLE 4

| | Material | Amount used (parts by mass) |
|---|---|---|
| Component (1) | Styrene-butadiene rubber (SBR) (trade name: Tufdene 2003, manufactured by Asahi Kasei Chemicals Corporation) | 100 |
| | Carbon black (trade name: KETJENBLACK EC600JD, manufactured by Lion Corporation) | 8 |
| | Carbon black (trade name: SEAST 5, manufactured by Tokai Carbon Co., Ltd.) | 40 |

TABLE 4-continued

| | Material | Amount used (parts by mass) |
|---|---|---|
| | Zinc oxide (trade name: Zinc Oxide No. 2, manufactured by Sakai Chemical Industry Co., Ltd.) | 5 |
| | Zinc stearate (trade name: SZ-2000, manufactured by Sakai Chemical Industry Co., Ltd.) | 1 |
| | Calcium carbonate (trade name: NANOX#30, manufactured by Maruo Calcium Co., Ltd.) | 15 |
| Component (2) | Resin particle No. 5 | 12 |
| | Sulfur (vulcanizing agent) | 1 |
| | Vulcanization accelerator dibenzothiazyl disulfide (trade name: NOCCELER-DM, manufactured by Ouchi Shinko Chemical Industrial Co., Ltd.; hereinafter, sometimes abbreviated as "DM") | 1 |
| | Vulcanization accelerator tetramethylthiuram monosulfide (trade name: NOCCELER-TS, manufactured by Ouchi Shinko Chemical Industrial Co., Ltd.; hereinafter, sometimes abbreviated as "TS") | 1 |

Production Example 29

Production of Electro-Conductive Rubber Composition No. 9

Electro-conductive rubber composition No. 9 was obtained as the same way as in Production Example 25 except that, in Production Example 25, the acrylonitrile-butadiene rubber was changed to a butadiene rubber (BR) (trade name: JSR BR01, manufactured by JSR Corporation) and the amount of the carbon black was changed to 30 parts by mass.

Production Example 31

Production of Electro-Conductive Rubber Composition No. 11

To 100 parts by mass of an acrylonitrile-butadiene rubber (NBR) (trade name: N230SV, manufactured by JSR Corporation), other materials listed in the column "Component (1)" in Table 5 were added, and the resultant was kneaded using a sealed mixer with the temperature controlled to 50° C. for 15 minutes. To this kneaded product, materials listed in the column "Component (2)" in Table 5 were added. The resultant was then kneaded using a two-roll mill cooled to a temperature of 25° C. for 10 minutes to obtain electro-conductive rubber composition No. 11.

TABLE 5

| | Material | Amount used (parts by mass) |
|---|---|---|
| Component (1) | Acrylonitrile-butadiene rubber (NBR) (trade name: N230SV, manufactured by JSR Corporation) | 100 |
| | Carbon black (trade name: TOKABLACK #7360SB, manufactured by Tokai Carbon Co., Ltd.) | 48 |
| | Zinc oxide (trade name: Zinc Oxide No. 2, manufactured by Sakai Chemical Industry Co., Ltd.) | 5 |

TABLE 5-continued

| | Material | Amount used (parts by mass) |
|---|---|---|
| | Zinc stearate (trade name: SZ-2000, manufactured by Sakai Chemical Industry Co., Ltd.) | 1 |
| | Calcium carbonate (trade name: NANOX#30, manufactured by Maruo Calcium Co., Ltd.) | 20 |
| | Silicone oil (trade name: KF-96-50CS, manufactured by Shin-Etsu Chemical Co., Ltd.) | 0.8 |
| Component (2) | Resin particle No. 1 | 12 |
| | Vulcanizing agent sulfur | 1.2 |
| | Vulcanization accelerator tetrabenzylthiuram disulfide (TBzTD) (trade name: PERKACIT TBzTD, manufactured by Performance Additives) | 4.5 |

TABLE 6

| Silicone oil No. | Trade name | Viscosity $mm^2/s$ | Structure | Manufacturer |
|---|---|---|---|---|
| 51 | KF-96-200CS | 200 | Dimethyl | Shin-Etsu Chemical Co., Ltd. |
| S2 | KF-96-100CS | 100 | Dimethyl | Shin-Etsu Chemical Co., Ltd. |
| S3 | KF-96-50CS | 50 | Dimethyl | Shin-Etsu Chemical Co., Ltd. |
| S4 | KF-96-30CS | 30 | Dimethyl | Shin-Etsu Chemical Co., Ltd. |
| S5 | KF-96-20CS | 20 | Dimethyl | Shin-Etsu Chemical Co., Ltd. |
| S6 | KF-50-100CS | 100 | Dimethyl-diphenyl | Shin-Etsu Chemical Co., Ltd. |
| S7 | TSF-431 | 100 | Dimethyl-diphenyl | Momentive Performance Materials Japan Limited Liability Co. |
| S8 | X-22-163B | 60 | Epoxy at both ends | Shin-Etsu Chemical Co., Ltd. |
| S9 | X-22-173DX | 60 | Epoxy at one end | Shin-Etsu Chemical Co., Ltd. |

The formulations for the above respective electro-conductive rubber compositions Nos. 1 to 21 are shown in Table 7.

TABLE 7

| Production Example | Electro-conductive rubber composition No. | Rubber Type | Rubber Trade name | CB Trade name | CB parts [phr] | Zinc oxide parts [phr] | Zinc stearate parts [phr] | Calcium carbonate parts [phr] | Silicone oil No. | Silicone oil parts [phr] | Sulfur parts [phr] | Vulcanization accelerator Type | Vulcanization accelerator parts [phr] | Resin particle No. | Resin particle parts [phr] |
|---|---|---|---|---|---|---|---|---|---|---|---|---|---|---|---|
| 21 | 1 | NBR | N230SV | #7360SB | 48 | 5 | 1 | 20 | — | 0 | 1.2 | TBzTD | 4.5 | 1 | 12 |
| 22 | 2 | | | | | | | | — | 0 | | | | 2 | 12 |
| 23 | 3 | | | | | | | | — | 0 | | | | 3 | 12 |
| 24 | 4 | | | | | | | | — | 0 | | | | 4 | 12 |
| 25 | 5 | | | | | | | | — | 0 | | | | 5 | 12 |
| 26 | 6 | | | | | | | | — | 0 | | | | 6 | 12 |
| 27 | 7 | | | | | | | | — | 0 | | | | 7 | 12 |
| 28 | 8 | SBR | Tufdene 2003 | KETJEN SEAST | 8<br>40 | 5 | 1 | 15 | — | 0 | 1 | DM<br>TS | 1<br>1 | 5 | 12 |
| 29 | 9 | BR | BR01 | #7360SB | 30 | 5 | 1 | 20 | — | 0 | 1.2 | TBzTD | 4.5 | 5 | 12 |
| 30 | 10 | NBR | N230SV | #7360SB | 48 | 5 | 1 | 20 | — | 0 | 1.2 | TBzTD | 4.5 | 8 | 12 |
| 31 | 11 | NBR | N230SV | #7360SB | 48 | 5 | 1 | 20 | S3 | 0.8 | 1.2 | TBzTD | 4.5 | 1 | 12 |
| 32 | 12 | | | | | | | | S3 | 0.2 | | | | | |
| 33 | 13 | | | | | | | | S3 | 2.0 | | | | | |
| 34 | 14 | | | | | | | | S4 | 0.8 | | | | | |
| 35 | 15 | | | | | | | | S5 | 0.8 | | | | | |
| 36 | 16 | | | | | | | | S2 | 0.8 | | | | | |
| 37 | 17 | | | | | | | | S1 | 0.8 | | | | | |
| 38 | 18 | | | | | | | | S6 | 0.8 | | | | | |
| 39 | 19 | | | | | | | | S7 | 0.8 | | | | | |
| 40 | 20 | | | | | | | | S8 | 0.8 | | | | | |
| 41 | 21 | | | | | | | | S9 | 0.8 | | | | | |

Production Examples 32 to 41

Production of Electro-Conductive Rubber Compositions Nos. 12 to 21

Electro-conductive rubber compositions Nos. 12 to 21 were obtained in the same way as in Production Example 31 except that the oil type and parts of a silicone oil to be added were changed to the silicone oils and the amounts to be added listed in Table 7. The details of the silicone oils used are shown in Table 6.

Example 1

[1. Electro-Conductive Substrate]

A thermosetting resin containing 10% by mass of carbon black was applied onto a stainless steel substrate with a diameter of 6 mm and a length of 252.5 mm and dried, which was used as an electro-conductive substrate.

[2. Formation of Electro-Conductive Elastic Layer]

Using an extrusion machine provided with a crosshead, the circumferential surface of the electro-conductive substrate as a central axis was cylindrically coated with the electro-conductive rubber composition 1 produced in Production Example 21. The thickness of the coating of the electro-conductive rubber composition was adjusted to 1.75 mm.

The roller after extrusion was vulcanized in a hot air furnace at 160° C. for 1 hour, and the ends of the rubber layer was then removed to a length of 224.2 mm to produce a roller having a pre-coating layer. The outer circumferential surface of the obtained roller was ground using a plunge-cutting type cylinder grinder. A vitrified grinding wheel was used for the abrasive grain, the material of which was green silicon carbide (GC) and the grain size was 100 mesh. The rotational frequency of the roller was set to 350 rpm and the rotational frequency of the grinding wheel was set to 2050 rpm. Grinding was carried out with the cut-in speed set to 20 mm/min and with the spark-out time (time of 0 mm cut-in) set to 0 seconds to produce an electro-conductive roller having an electro-conductive elastic layer (coating layer). The thickness of the electro-conductive elastic layer was adjusted to 1.5 mm. The quantity of the crown (the average value of differences between the outer diameter of the center portion and the outer diameter at a position distant from the center portion to the direction of the respective ends by 90 mm) of this roller was 120 μm.

After grinding, post-heat treatment was performed using a hot air furnace at 180° C. in the atmosphere for 1 hour to obtain a charging member 1. This charging member 1 included an electro-conductive resin layer having a protrusion derived from the edge of an opening of a bowl-shaped resin particle and a concavity derived from an opening of a bowl-shaped resin particle on the surface.

[3. Method for Evaluating Physical Properties of Charging Member and Method for Evaluating Image]

[3-1. Measurement for Surface Roughness Rzjis and Mean Peak Spacing Sm of Charging Member]

Measurement was performed according to the standard of JIS B 0601-1994 surface roughness using a surface roughness meter (trade name: SE-3500, manufactured by Kosaka Laboratory Ltd.). For Rz and Sm, measurements were obtained at randomly selected 6 points of the charging member and the average value of the measurements was used. The cut-off value was 0.8 mm and the evaluation length was 8 mm.

[3-2. Measurement for Shape of Bowl-Shaped Resin Particle]

The number of measurement points was 10 in total: specifically, 5 points consisting of the center portion, points distant from the center portion to the direction of the respective ends by 45 mm, and points distant from the center portion to the direction of the respective ends by 90 mm in the longitudinal direction of the charging member were measured at 2 phases in the circumferential direction (phases 0° and 180°) of the charging member. At each of these measurement points, the electro-conductive resin layer was cut off at every 20 nm depth over 500 μm depth and the cross-sectional images were taken using a focused ion beam processing/observation apparatus (trade name: FB-2000C, manufactured by Hitachi, Ltd.). The obtained cross-sectional images were then combined to determine the stereoscopic image of the bowl-shaped resin particle. From the stereoscopic image, the "Maximum diameter" 55 as illustrated in FIG. 6 and the "Minimum diameter of opening portion" as illustrated in FIGS. 7A to 7E were calculated. The definition of "Maximum diameter" is as described above.

Further, at arbitrarily selected 10 points of the bowl-shaped resin particle in the above stereoscopic image, the "difference between outer diameter and inner diameter", i.e., the "Shell thickness" of the bowl-shaped resin particle was calculated. This measurement was performed for 10 resin particles in the view, and the average value of the obtained 100 measurements in total was calculated. The "Maximum diameter", "Minimum diameter of opening portion" and "Shell thickness" shown in Table 9-1 are each the average value calculated using the above method. In measuring the shell thickness, it was confirmed for each of the bowl-shaped resin particles that the thickness of the thickest portion of the shell was twice the thickness of the thinnest portion or less, that is, the shell thickness was generally uniform.

[3-3. Measurement for Height Difference Between Top of Protrusion and Bottom of Concavity on Surface of Charging Member]

The surface of the charging member was observed using a laser microscope (trade name: LSM5 PASCAL, manufactured by Carl Zeiss) with a view of 0.5 mm height×0.5 mm width. The X-Y plane in the view was scanned with a laser to obtain two-dimensional image data, and the focus was moved in the Z direction to carry out the above scanning. These operations were repeated to obtain three-dimensional image data. From the result, it was first confirmed that the concavity derived from the opening of the bowl-shaped resin particle and the protrusion derived from the edge of the opening of the bowl-shaped resin particle were present. Further, the height difference 54 between the top of the protrusion and the bottom of the concavity was calculated. These operations were performed for two bowl-shaped resin particles in the view. And the same measurement was performed at 50 points in the longitudinal direction of the charging member, and the average value of the obtained measurements for 100 resin particles in total was calculated, which was shown in Table 9-1 as "Height difference".

[3-4. Measurement for Electrical Resistance of Charging Member]

Figure 4:
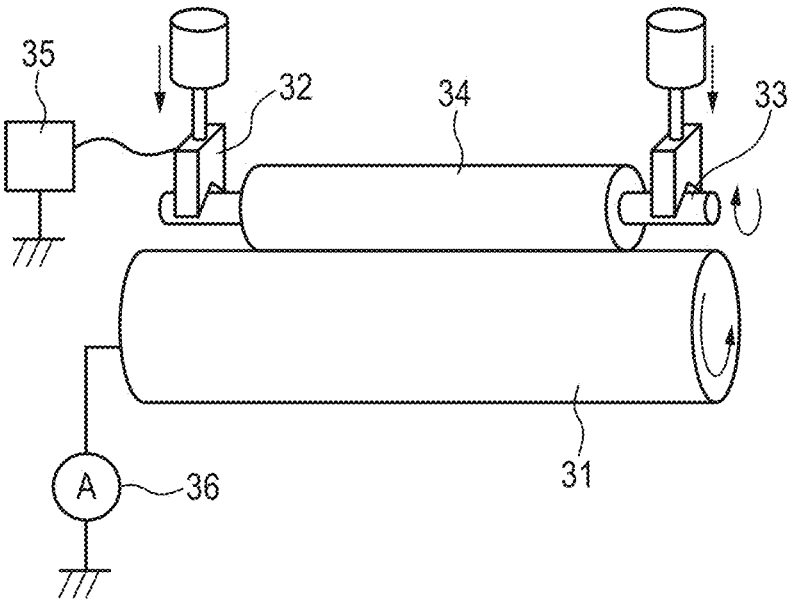
FIG. 4 is a schematic diagram of an electric current measuring apparatus.

FIG. 4 illustrates an apparatus for measuring the electrical resistance value of a charging member 34. Both ends of an electro-conductive substrate 33 were applied with a load through bearings 32 to bring the charging member 34 into contact with a cylindrical metal 31 having the same curvature as that of an electrophotographic photosensitive member so as to be parallel to the cylindrical metal 31. While this state was maintained, the cylindrical metal 31 was rotated with a motor (not illustrated), and a DC voltage of −200 V from a stabilized power supply 35 was applied thereto with the charging member 34 in contact driven-rotated. The electrical current at this time was measured using an ammeter 36, and the electrical resistance value of the charging member 34 was calculated. The loads were each 4.9 N, the diameter of the cylindrical metal 31 was 30 mm, and the rotational speed of the cylindrical metal 31 was 45 mm/sec. Before measurement, the charging member 34 was left to stand under an environment with a temperature of 23° C. and a relative humidity of 50% for 24 hours or longer, and measurement was performed by using a measuring apparatus which had been kept under the same environment.

[3-5. Calculation of Brightness Due to Electroconductivity of Concaves and Protrusions on Surface of Charging Member]

A scanning electron microscope (ULTRA plus, manufactured by Carl Zeiss) was customized so that a DC power supply (P4K-80H, manufactured by Matsusada Precision Inc.) could be connected thereto via a vacuum feedthrough, and observation was carried out. An electrical potential of 75 V was applied to the electro-conductive substrate, an electron beam was irradiated on the surface of the charging member at an accelerating voltage of 1.0 kV, and a region in which both the concavity derived from the bowl-shaped resin particle and the binder on the surface of the charging member could be observed was observed using a working distance (WD) of 2.8 mm, a magnification of ×2000, a contrast of 50% and a brightness of 28% to obtain a secondary electron image.

In this secondary electron image, the brightness K1 of the protrusion derived from the bowl-shaped resin particle, the brightness K2 of the bottom of the concavity derived from the bowl-shaped resin particle and the brightness K3 of the binder beside the bowl-shaped resin particle were calculated using an image analysis software (ImageProPlus (R), manufactured by Adobe Systems Inc.). For each brightness, the average brightness value of all the pixels within a region of 10 μm×10 μm was measured at 4 positions, and the average value of these 4 average brightness values was used.

[3-6. Image Evaluation]

A monochrome laser printer ("LBP6700" (trade name)) manufactured by Canon Inc., an electrophotographic apparatus having a configuration illustrated in FIG. 12, was customized to make the process speed 370 mm/sec, and a voltage was further applied from the outside to the charging member. For the voltage, an AC voltage with a peak-to-peak voltage (Vpp) of 1800 V and a frequency (f) of 1350 Hz and a DC voltage (Vdc) of −600 V were applied. The resolution of an image to be output was 600 dpi.

As a process cartridge, the toner cartridge 524II for the above printer was used. An attached charging roller was detached from the process cartridge, and the charging member 1 was set thereon in place of the charging roller. The charging member 1 was brought into contact with the electrophotographic photosensitive member with a pressing pressure of 4.9 N at one end, i.e., 9.8 N in total at both ends through springs. This process cartridge was conditioned in a low temperature and low humidity environment with a temperature of 15° C. and a relative humidity of 10% for 24 hours, and thereafter image evaluation was performed. Specifically, a halftone image (an image drawn with horizontal lines of 1 dot in width at an interval of 2 dots in the direction perpendicular to the rotational direction of the electrophotographic photosensitive member) was output, and the obtained image was visually observed to determine whether a spotted image defect was present or not and whether a horizontally streaked image defect was present or not using the following criteria.

[Criteria for Spotted Image]

Rank 1: no spotted image defect was observed.

Rank 2: only a few spotted image defects were observed.

Rank 3: the occurrence of spotted image defects was observed in some regions corresponding to the rotation pitch of the charging member, but with no problem in practical use.

Rank 4: spotted image defects were observed in a broad range and noticeable.

[Criteria for Horizontally Streaked Image]

Rank 1: no horizontally streaked image defect was observed.

Rank 2: only a few horizontally streaked image defects were observed.

Rank 3: the occurrence of horizontally streaked image defects was observed in some regions corresponding to the rotation pitch of the charging member, but with no problem in practical use.

Rank 4: horizontally streaked image defects were observed in a broad range and noticeable.

Examples 2 to 10

Charging members Nos. 2 to 10 were produced in the same way as in Example 1 except that, in Example 1, the vulcanizing temperature and the heating temperature after grinding were changed to respective conditions listed in Table 8.

Examples 11 to 24

Charging members Nos. 11 to 24 were produced in the same way as in Example 1 except that, in Example 1, electro-conductive rubber composition No. 1 was changed to respective electro-conductive rubber compositions Nos. listed in Table 8 and the heating temperature after grinding was changed to respective conditions listed in Table 8.

Example 25

The processes before and including grinding were carried out in the same way as in Example 13 to produce a ground electro-conductive roller. And then, a zinc oxide powder (trade name: 23-K, manufactured by Hakusui Tech Co., Ltd.) as an electro-conductive fine particle was applied onto the surface of the electro-conductive roller utilizing the electric current measuring apparatus in FIG. 4. Specifically, each end of the ground electro-conductive roller was applied with a load of 4.9 N to bring into contact with a cylindrical metal 31 so as to be parallel to the cylindrical metal 31. While this state was maintained, the cylindrical metal 31 was rotated with a motor (not illustrated) at a rotational speed of 45 mm/sec, and a nonwoven cloth which had been infiltrated with the zinc oxide powder was pressed onto the electro-conductive roller driven-rotating together with the cylindrical metal 31 for application.

While this state was maintained, only the outermost surface was reground to a depth of 10 μm to obtain charging member No. 25 with the zinc oxide powder deposited only on the concavity of the bowl-shaped resin particle.

Examples 26 and 27

Charging members Nos. 26 and 27 were produced in the same way as in Example 25 except that the electro-conductive fine particle to be applied onto a ground electro-conductive roller was changed to a zinc oxide powder (trade name: Pazet CK, manufactured by Hakusui Tech Co., Ltd.) and a zinc oxide powder (trade name: Pazet AB, manufactured by Hakusui Tech Co., Ltd.), respectively.

Examples 28 to 38

Charging members Nos. 28 to 38 were produced in the same way as in Example 3 except that, in Example 3, the electro-conductive rubber composition No. was changed to respective electro-conductive rubber compositions listed in Table 8.

Example 39

Charging member No. 39 was produced in the same way as in Example 28 except that, in Example 28, the heating after grinding was not carried out.

[3-7. Confirmation of Localized Silicone Oil]

Measurement was performed using an apparatus (TRIFT V nano TOF, manufactured by ULVAC-PHI, Inc.) for secondary ion mass spectroscopy (TOF-SIMS). For each measurement point of the interior of the bowl-shaped resin particle on the surface of an electro-conductive roller and the electro-conductive resin layer included in the surface of an electro-conductive roller, 5 points were measured. At each measurement point, the spectrum was extracted from the secondary ion image using an ROI (Region Of Interest) function, and the peak strengths of m/z=$^{28}Si$, $^{73}C_3H_9Si$, which are components derived from silicon and organic silicon, respectively, were each normalized to the total secondary ion strength. The average value of the 5 points for each measurement point of the interior of the bowl-shaped resin particle and the electro-conductive resin layer included in the surface of an electro-conductive roller was calculated, from which the ratio of the measurement J2 of the electro-conductive resin layer included in the surface of an electro-conductive roller to the measurement J1 of the interior of the bowl-shaped resin particle, i.e. J2/J1, was calculated.

Comparative Examples 1 and 2

Charging members Nos. C1 and C2 were produced in the same way as in Example 1 except that the heating temperature after grinding was changed to 170° C. and 220° C., respectively.

Comparative Example 3

Charging member No. C3 was produced in the same way as in Example 2 except that electro-conductive rubber composition No. 1 was changed to electro-conductive rubber composition No. 10.

Comparative Example 4

Charging member No. C4 was produced in the same way as in Example 2 except that electro-conductive rubber composition No. 1 was changed to electro-conductive rubber composition No. 10 and the heating temperature after grinding was changed to 210° C.

Comparative Example 5

Charging member No. C5 was produced in the same way as in Example 25 except that the electro-conductive fine particle to be applied onto a ground electro-conductive roller was changed to a graphite powder (trade name: UF-G5, manufactured by Showa Denko K.K.).

Comparative Example 6

The processes before and including grinding were carried out in the same way as in Example 1 to produce a ground electro-conductive roller. Then, charging member No. C6 was produced in the same way as in Example 27.

Comparative Example 7

The processes before and including heat treatment after grinding were carried out in the same way as in Example 3 to produce a ground electro-conductive roller. Thereafter, charging member No. C7 was produced in the same way as in Comparative Example 6.

The electro-conductive rubber composition No. used for production, vulcanizing temperature in producing the resin particle No. and heating temperature after grinding for each of charging members Nos. 1 to 39 according to Examples 1 to 39 and charging members Nos. C1 to C7 according to Comparative Examples 1 to 7 are shown in Table 8. Further, the measurement result and evaluation result for each of charging members Nos. 1 to 39 according to Examples 1 to 39 and charging members Nos. C1 to C7 according to Comparative Examples 1 to 7 are shown in Tables 9-1 and 9-2.

TABLE 8

| | | Charging member No. | Electro-conductive rubber composition No. | Resin particle No. | Vulcanizing temperature [° C.] | Heating temperature after grinding [° C.] |
|---|---|---|---|---|---|---|
| Example | 1 | 1 | 1 | 1 | 160 | 180 |
| | 2 | 2 | 1 | 1 | 160 | 190 |
| | 3 | 3 | 1 | 1 | 160 | 200 |
| | 4 | 4 | 1 | 1 | 160 | 210 |
| | 5 | 5 | 1 | 1 | 170 | 190 |
| | 6 | 6 | 1 | 1 | 170 | 200 |
| | 7 | 7 | 1 | 1 | 180 | 190 |
| | 8 | 8 | 1 | 1 | 180 | 200 |
| | 9 | 9 | 1 | 1 | 190 | 190 |
| | 10 | 10 | 1 | 1 | 190 | 200 |
| | 11 | 11 | 2 | 2 | 160 | 190 |
| | 12 | 12 | 2 | 2 | 160 | 200 |
| | 13 | 13 | 3 | 3 | 160 | 190 |
| | 14 | 14 | 3 | 3 | 160 | 200 |
| | 15 | 15 | 4 | 4 | 160 | 190 |
| | 16 | 16 | 4 | 4 | 160 | 200 |
| | 17 | 17 | 5 | 5 | 160 | 190 |
| | 18 | 18 | 5 | 5 | 160 | 200 |
| | 19 | 19 | 6 | 6 | 160 | 190 |
| | 20 | 20 | 6 | 6 | 160 | 200 |
| | 21 | 21 | 7 | 7 | 160 | 190 |
| | 22 | 22 | 7 | 7 | 160 | 200 |
| | 23 | 23 | 8 | 5 | 160 | 200 |
| | 24 | 24 | 9 | 5 | 160 | 200 |
| | 25 | 25 | 3 | 3 | 160 | — |
| | 26 | 26 | 3 | 3 | 160 | — |
| | 27 | 27 | 3 | 3 | 160 | — |
| | 28 | 28 | 11 | 1 | 160 | 200 |
| | 29 | 29 | 12 | 1 | 160 | 200 |
| | 30 | 30 | 13 | 1 | 160 | 200 |
| | 31 | 31 | 14 | 1 | 160 | 200 |
| | 32 | 32 | 15 | 1 | 160 | 200 |

TABLE 8-continued

| | | Charging member No. | Electro-conductive rubber composition No. | Resin particle No. | Vulcanizing temperature [° C.] | Heating temperature after grinding [° C.] |
|---|---|---|---|---|---|---|
| | 33 | 33 | 16 | 1 | 160 | 200 |
| | 34 | 34 | 17 | 1 | 160 | 200 |
| | 35 | 35 | 18 | 1 | 160 | 200 |
| | 36 | 36 | 19 | 1 | 160 | 200 |
| | 37 | 37 | 20 | 1 | 160 | 200 |
| | 38 | 38 | 21 | 1 | 160 | 200 |
| | 39 | 28 | 11 | 1 | 160 | — |
| Comparative | 1 | C1 | 1 | 1 | 160 | 170 |
| Example | 2 | C2 | 1 | 1 | 160 | 220 |
| | 3 | C3 | 10 | 8 | 160 | 190 |
| | 4 | C4 | 10 | 8 | 190 | 200 |
| | 5 | C5 | 1 | 1 | 160 | — |
| | 6 | C6 | 1 | 1 | 160 | — |
| | 7 | C7 | 1 | 1 | 160 | 200 |

TABLE 9-1

| | | Resistance of roller [Ω] | Rz [μm] | Sm [μm] | Height difference [μm] | Maximum diameter [μm] | Minimum diameter of opening portion [μm] | Shell thickness [μm] |
|---|---|---|---|---|---|---|---|---|
| Example | 1 | $3.4 \times 10^5$ | 42 | 94 | 49 | 68 | 45 | 1.5 |
| | 2 | $5.4 \times 10^5$ | 42 | 93 | 49 | 68 | 45 | 1.5 |
| | 3 | $6.6 \times 10^5$ | 42 | 92 | 49 | 68 | 45 | 1.5 |
| | 4 | $4.9 \times 10^5$ | 42 | 90 | 49 | 68 | 45 | 1.5 |
| | 5 | $4.7 \times 10^5$ | 44 | 88 | 50 | 69 | 47 | 1.3 |
| | 6 | $5.5 \times 10^5$ | 44 | 87 | 50 | 69 | 47 | 1.3 |
| | 7 | $3.2 \times 10^5$ | 46 | 85 | 51 | 72 | 50 | 1.2 |
| | 8 | $4.0 \times 10^5$ | 46 | 85 | 51 | 72 | 50 | 1.2 |
| | 9 | $2.2 \times 10^5$ | 47 | 80 | 53 | 74 | 54 | 0.9 |
| | 10 | $2.9 \times 10^5$ | 47 | 80 | 53 | 74 | 54 | 0.9 |
| | 11 | $1.9 \times 10^5$ | 26 | 110 | 30 | 33 | 24 | 0.6 |
| | 12 | $2.8 \times 10^5$ | 26 | 110 | 30 | 33 | 24 | 0.6 |
| | 13 | $8.4 \times 10^5$ | 70 | 67 | 83 | 104 | 82 | 2 |
| | 14 | $9.3 \times 10^5$ | 70 | 67 | 83 | 104 | 82 | 2 |
| | 15 | $4.0 \times 10^5$ | 39 | 97 | 46 | 65 | 42 | 1.4 |
| | 16 | $4.6 \times 10^5$ | 39 | 97 | 46 | 65 | 42 | 1.4 |
| | 17 | $3.1 \times 10^5$ | 37 | 98 | 41 | 59 | 39 | 1.2 |
| | 18 | $3.7 \times 10^5$ | 37 | 98 | 41 | 59 | 39 | 1.2 |
| | 19 | $9.2 \times 10^5$ | 50 | 76 | 52 | 84 | 64 | 2.4 |
| | 20 | $1.1 \times 10^6$ | 50 | 76 | 52 | 84 | 64 | 2.4 |
| | 21 | $2.9 \times 10^5$ | 38 | 104 | 44 | 72 | 52 | 1.4 |
| | 22 | $3.8 \times 10^5$ | 38 | 104 | 44 | 72 | 52 | 1.4 |
| | 23 | $3.5 \times 10^5$ | 49 | 102 | 54 | 74 | 48 | 1.1 |
| | 24 | $2.2 \times 10^5$ | 52 | 112 | 60 | 80 | 54 | 1 |
| | 25 | $3.3 \times 10^5$ | 61 | 67 | 73 | 96 | 70 | 2 |
| | 26 | $5.0 \times 10^5$ | 60 | 67 | 72 | 95 | 69 | 2 |
| | 27 | $1.2 \times 10^6$ | 61 | 67 | 73 | 96 | 70 | 2 |
| | 28 | $7.2 \times 10^5$ | 44 | 93 | 50 | 68 | 45 | 1.5 |
| | 29 | $6.7 \times 10^5$ | 42 | 92 | 49 | 68 | 45 | 1.5 |
| | 30 | $7.6 \times 10^5$ | 46 | 93 | 51 | 69 | 46 | 1.5 |
| | 31 | $7.0 \times 10^5$ | 45 | 92 | 50 | 68 | 45 | 1.5 |
| | 32 | $6.7 \times 10^5$ | 46 | 92 | 51 | 69 | 46 | 1.5 |
| | 33 | $7.4 \times 10^5$ | 43 | 93 | 49 | 68 | 45 | 1.5 |
| | 34 | $7.6 \times 10^5$ | 42 | 92 | 49 | 68 | 45 | 1.5 |
| | 35 | $7.2 \times 10^5$ | 43 | 93 | 49 | 68 | 45 | 1.5 |
| | 36 | $7.2 \times 10^5$ | 43 | 93 | 49 | 68 | 45 | 1.5 |
| | 37 | $7.2 \times 10^5$ | 45 | 93 | 50 | 68 | 45 | 1.5 |
| | 38 | $7.2 \times 10^5$ | 45 | 93 | 50 | 68 | 45 | 1.5 |
| | 39 | $6.7 \times 10^5$ | 44 | 93 | 49 | 68 | 45 | 1.5 |
| Comparative | 1 | $1.9 \times 10^5$ | 42 | 94 | 49 | 68 | 45 | 1.5 |
| Example | 2 | $2.3 \times 10^4$ | 44 | 90 | 51 | 75 | 49 | 1.3 |
| | 3 | $3.4 \times 10^6$ | 50 | 105 | 55 | 88 | 60 | 3.5 |
| | 4 | $5.0 \times 10^6$ | 50 | 105 | 55 | 88 | 60 | 3.5 |
| | 5 | $1.9 \times 10^4$ | 61 | 67 | 73 | 96 | 70 | 2 |
| | 6 | $2.0 \times 10^5$ | 40 | 94 | 48 | 66 | 45 | 1.6 |
| | 7 | $3.2 \times 10^5$ | 41 | 94 | 49 | 68 | 45 | 1.5 |

TABLE 9-2

| | | Brightness K1 | Brightness K2 | Brightness K3 | K2/K3 | J2/J1 | Image rank (spotted image) | Image rank (horizontally striped image) |
|---|---|---|---|---|---|---|---|---|
| Example | 1 | 168 | 148 | 126 | 1.17 | — | 3 | 1 |
| | 2 | 168 | 148 | 129 | 1.15 | — | 2 | 1 |
| | 3 | 171 | 148 | 131 | 1.13 | — | 2 | 1 |
| | 4 | 172 | 139 | 116 | 1.20 | — | 3 | 1 |
| | 5 | 168 | 146 | 131 | 1.11 | — | 2 | 1 |
| | 6 | 171 | 146 | 133 | 1.10 | — | 1 | 1 |
| | 7 | 168 | 142 | 132 | 1.08 | — | 1 | 1 |
| | 8 | 171 | 142 | 134 | 1.06 | — | 1 | 1 |
| | 9 | 168 | 140 | 134 | 1.04 | — | 1 | 1 |
| | 10 | 171 | 140 | 136 | 1.03 | — | 1 | 1 |
| | 11 | 168 | 149 | 129 | 1.16 | — | 3 | 1 |
| | 12 | 171 | 149 | 131 | 1.14 | — | 2 | 1 |
| | 13 | 168 | 152 | 129 | 1.18 | — | 3 | 1 |
| | 14 | 171 | 152 | 131 | 1.16 | — | 3 | 1 |
| | 15 | 166 | 144 | 129 | 1.12 | — | 2 | 1 |
| | 16 | 169 | 144 | 131 | 1.10 | — | 1 | 1 |
| | 17 | 162 | 135 | 129 | 1.05 | — | 1 | 1 |
| | 18 | 165 | 135 | 131 | 1.03 | — | 1 | 1 |
| | 19 | 170 | 155 | 129 | 1.20 | — | 3 | 1 |
| | 20 | 173 | 155 | 131 | 1.18 | — | 2 | 1 |
| | 21 | 171 | 137 | 129 | 1.06 | — | 1 | 1 |
| | 22 | 172 | 137 | 131 | 1.05 | — | 1 | 1 |
| | 23 | 162 | 144 | 131 | 1.10 | — | 1 | 1 |
| | 24 | 165 | 150 | 131 | 1.15 | — | 2 | 1 |
| | 25 | 167 | 93 | 116 | 0.80 | — | 3 | 1 |
| | 26 | 167 | 110 | 116 | 0.95 | — | 1 | 1 |
| | 27 | 167 | 122 | 116 | 1.05 | — | 1 | 1 |
| | 28 | 172 | 149 | 148 | 1.01 | 4.50 | 1 | 1 |
| | 29 | 171 | 148 | 133 | 1.11 | 2.22 | 2 | 1 |
| | 30 | 173 | 150 | 165 | 0.91 | 8.12 | 2 | 1 |
| | 31 | 172 | 148 | 140 | 1.06 | 3.85 | 1 | 1 |
| | 32 | 171 | 148 | 132 | 1.12 | 2.02 | 2 | 1 |
| | 33 | 171 | 151 | 137 | 1.10 | 3.01 | 1 | 1 |
| | 34 | 171 | 155 | 138 | 1.12 | 1.92 | 2 | 1 |
| | 35 | 171 | 148 | 133 | 1.11 | 2.44 | 2 | 1 |
| | 36 | 171 | 148 | 133 | 1.11 | 2.34 | 2 | 1 |
| | 37 | 171 | 148 | 132 | 1.12 | 2.22 | 2 | 1 |
| | 38 | 171 | 148 | 135 | 1.10 | 2.89 | 1 | 1 |
| | 39 | 171 | 148 | 131 | 1.20 | 4.62 | 3 | 1 |
| Comparative Example | 1 | 166 | 148 | 122 | 1.21 | — | 4 | 1 |
| | 2 | 175 | 135 | 101 | 1.34 | — | 4 | 1 |
| | 3 | 178 | 165 | 129 | 1.28 | — | 4 | 1 |
| | 4 | 178 | 165 | 131 | 1.26 | — | 4 | 1 |
| | 5 | 166 | 85 | 116 | 0.73 | — | 4 | 1 |
| | 6 | 99 | 122 | 101 | 1.21 | — | 4 | 4 |
| | 7 | 100 | 122 | 110 | 1.11 | — | 2 | 4 |

Regarding a spotted image, Examples 1 to 38 each provided satisfactory evaluation result since the value of K2/K3 satisfied the range represented by expression (3). On the other hand, in each of Comparative Examples 1 to 4, owing to that the value of K2/K3 was larger than the upper limit of the range represented by expression (3), abnormal discharge occurred due to the concentration of an electric field on the electro-conductive resin portion exposed at the surface, and as a result a spotted image was observed in a broad range. In Comparative Example 5, owing to that the value of K2/K3 was smaller than the lower limit of the range represented by expression (3), abnormal discharge occurred due to the concentration of an electric field on the concavity derived from the bowl-shaped resin particle, and as a result a spotted image was observed in a broad range.

Regarding a horizontally streaked image, Examples 1 to 38 and Comparative Examples 1 to 5 each provided satisfactory evaluation result since expressions (1) and (2) were satisfied. On the other hand, in Comparative Examples 6 and 7, expressions (1) and (2) were not satisfied and electrical attraction poorly acted between the edge portion derived from the bowl-shaped resin particle and the photosensitive member, and as a result a horizontally streaked image was observed owing to abnormal discharge due to stick-slip.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-077015, filed Apr. 3, 2015, which is hereby incorporated by reference herein in its entirety.

What is claimed is:

1. An electrophotographic member comprising:

an electro-conductive substrate; and an electro-conductive resin layer as a surface layer on the substrate, the electro-conductive resin layer comprising a binder and retaining a bowl-shaped resin particle having an opening that is exposed at a surface of the electrophotographic member;

the surface of the electrophotographic member comprising a concavity derived from the opening of the bowl-shaped resin particle exposed at the surface, and a protrusion derived from an edge of the opening of the bowl-shaped resin particle exposed at the surface; and a part of the surface of the electrophotographic member is constituted by the electro-conductive resin layer, wherein a brightness observed at a bottom of the concavity K2< a brightness observed at the protrusion K1, a brightness observed at an exposed surface of the electro-conductive resin layer K3 < a brightness observed at the protrusion K1, and $$0.8 \leq K2/K3 \leq 1.2$$

when the surface of the electrophotographic member is observed with a scanning electron microscope at an accelerating voltage of 1 kV and a magnification of ×2000 while applying a DC voltage of 50 to 100 V between an electrode disposed opposite to the electrophotographic member and the electro-conductive substrate.

2. The electrophotographic member according to claim 1 wherein a silicone oil is contained in the electro-conductive resin layer constituting a part of the surface of the electrophotographic member.

3. A method for producing an electrophotographic member comprising an electro-conductive substrate and an electro-conductive resin layer as a surface layer on the substrate, comprising the steps of:

(1) forming a coating layer of a composition comprising a hollow-shaped resin particle dispersed in a binder on the substrate;

(2) grinding a surface of the coating layer, and partly removing a shell of the hollow-shaped resin particle to form a bowl-shaped resin particle having an opening, and to make a concavity derived from the opening of the bowl-shaped resin particle and a protrusion derived from an edge of the opening on the surface of the coating layer;

(3) allowing an electro-conductive fine particle to be present at a surface of the concavity; and regrinding the surface of the coating layer after the allowing an electro-conductive fine particle to be present at a surface of the concavity.

4. A method for producing an electrophotographic member comprising an electro-conductive substrate and an electro-conductive resin layer as a surface layer on the substrate, the method comprising the steps of:

forming a coating layer of a thermally crosslinkable rubber composition comprising an electro-conductive fine particle, a thermally crosslinkable rubber and a hollow-shaped resin particle on the substrate;

grinding a surface of the coating layer, and partly removing a shell of the hollow-shaped resin particle to form a bowl-shaped resin particle having an opening, and to make a layer retaining the bowl-shaped resin particle so that the opening is exposed at the surface thereof; and thermally crosslinking the thermally crosslinkable rubber in the coating layer in the presence of oxygen to obtain an electrophotographic member having a concavity derived from the opening and a protrusion derived from an edge of the opening on the surface thereof, wherein a part of the surface is constituted by the electro-conductive resin layer, and oxygen transmission rate of the shell of the hollow-shaped resin particle is 140 $cm^3/(m^2 \cdot 24\ h \cdot atm)$ or less.

5. A process cartridge comprising an electrophotographic member and an electrophotographic photosensitive member and being configured to be attachable to and detachable from a main body of an electrophotographic apparatus, the electrophotographic member comprising:

an electro-conductive substrate; and an electro-conductive resin layer as a surface layer on the substrate, the electro-conductive resin layer comprising a binder and retaining a bowl-shaped resin particle having an opening that is exposed at a surface of the electrophotographic member;

the surface of the electrophotographic member comprising a concavity derived from the opening of the bowl-shaped resin particle exposed at the surface, and a protrusion derived from an edge of the opening of the bowl-shaped resin particle exposed at the surface; and a part of the surface of the electrophotographic member is constituted by the electro-conductive resin layer, wherein a brightness observed at a bottom of the concavity K2 < a brightness observed at the protrusion K1, a brightness observed at an exposed surface of the electro-conductive resin layer K3 < a brightness observed at the protrusion K1, and $$0.8 \leq K2/K3 \leq 1.2$$

when the surface of the electrophotographic member is observed with a scanning electron microscope at an accelerating voltage of 1 kV and a magnification of ×2000 while applying a DC voltage of 50 to 100 V between an electrode disposed opposite to the electrophotographic member and the substrate.

6. An electrophotographic apparatus comprising an electrophotographic member and an electrophotographic photosensitive member, the electrophotographic member comprising:

an electro-conductive substrate; and an electro-conductive resin layer as a surface layer on the substrate, the electro-conductive resin layer a bowl-shaped resin particle having an opening that is exposed at a surface of the electrophotographic member;

the surface of the electrophotographic member comprising a concavity derived from the opening of the bowl-shaped resin particle exposed at the surface, and a protrusion derived from an edge of the opening of the bowl-shaped resin particle exposed at the surface; and a part of the surface of the electrophotographic member is constituted by the electro-conductive resin layer, wherein a brightness observed at a bottom of the concavity K2 < a brightness observed at the protrusion K1, a brightness observed at an exposed surface of the electro-conductive resin layer K3 < a brightness observed at the protrusion K1, and $$0.8 \leq K2/K3 \leq 1.2$$

when the surface of the electrophotographic member is observed with a scanning electron microscope at an accelerating voltage of 1 kV and a magnification of ×2000 while applying a DC voltage of 50 to 100 V between an electrode disposed opposite to the electrophotographic member and the substrate.

* * * * *